US006208816B1

(12) United States Patent
Koizumi et al.

(10) Patent No.: US 6,208,816 B1
(45) Date of Patent: Mar. 27, 2001

(54) DEVELOPING DEVICE, PROCESS CARTRIDGE, ELECTROPHOTOGRAPHIC IMAGE FORMING APPARATUS AND AGITATING MEMBER

(75) Inventors: Toru Koizumi, Toride; Yoshiya Nomura, Tokyo, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/388,434

(22) Filed: Sep. 2, 1999

(30) Foreign Application Priority Data

Sep. 4, 1998 (JP) ..... 10-267384
Jul. 30, 1999 (JP) ..... 11-217096

(51) Int. Cl.[7] ..... G03G 15/08
(52) U.S. Cl. ..... 399/27; 399/61
(58) Field of Search ..... 399/27, 30, 58, 399/61, 62

(56) References Cited

U.S. PATENT DOCUMENTS

| | | | | |
|---|---|---|---|---|
| 4,133,453 | * | 1/1979 | Ohbora | 399/61 X |
| 4,364,659 | * | 12/1982 | Noda | 399/61 |
| 5,294,960 | | 3/1994 | Nomura et al. . | |
| 5,331,373 | | 7/1994 | Nomura et al. . | |
| 5,452,056 | | 9/1995 | Nomura et al. . | |
| 5,559,581 | | 9/1996 | Sugiura et al. . | |
| 5,561,496 | | 10/1996 | Sugiura et al. . | |
| 5,623,328 | | 4/1997 | Tsuda et al. | 399/111 |
| 5,634,178 | | 5/1997 | Sugiura et al. | 399/110 |
| 5,642,187 | | 6/1997 | Nomura et al. | 399/111 |
| 5,650,841 | | 7/1997 | Matsuda et al. | 399/111 |
| 5,678,139 | | 10/1997 | Nomura et al. | 399/114 |
| 5,697,022 | | 12/1997 | Matsuda et al. | 399/102 |
| 5,787,323 | | 7/1998 | Nomura et al. | 399/111 |
| 5,790,917 | * | 8/1998 | Takura et al. | 399/27 |
| 5,825,472 | | 10/1998 | Araki et al. . | |
| 5,828,928 | | 10/1998 | Sasago et al. | 399/111 |
| 5,839,028 | | 11/1998 | Nomura et al. | 399/109 |
| 5,864,731 | * | 1/1999 | Ikemoto et al. | 399/27 |
| 5,878,309 | | 3/1999 | Nomura et al. | 399/111 |
| 5,907,751 | | 5/1999 | Kawaguchi et al. | 399/117 |
| 5,923,917 | * | 7/1999 | Sakurai et al. | 399/27 |
| 5,987,269 | * | 11/1999 | Allen et al. | 399/27 |
| 6,035,150 | * | 3/2000 | Domon et al. | 399/27 |

* cited by examiner

*Primary Examiner*—Sandra Brase
(74) *Attorney, Agent, or Firm*—Fitzpatrick, Cella, Harper & Scinto

(57) ABSTRACT

A developing device, a process cartridge and an electrophotographic image forming apparatus include a device for successively detecting the toner remaining amount throughout the service life of the process cartridge. A first antenna rod is provided on a rotating agitating member, and an amount of toner between them is detected successively. By using a second fixed antenna provided in a toner container, the toner amount is successively detected when the toner amount is small. A toner scraping-off member contacting the rotating agitating member is provided in the toner container.

24 Claims, 19 Drawing Sheets

DEVELOPING DEVICE, PROCESS CARTRIDGE, ELECTROPHOTOGRAPHIC IMAGE FORMING APPARATUS AND AGITATING MEMBER

BACKGROUND OF THE INVENTION

1. Field of the Invention

The present invention relates to a developing device, a process cartridge, an electrophotographic image forming apparatus and an agitating member. The electrophotographic image forming apparatus serves to form an image on a recording medium by using an electrophotographic image forming process and may include an electrophotographic copying machine, an electrophotographic printer (for example, a laser beam printer, an LED printer and the like), a facsimile apparatus, a word processor and the like. The process cartridge is constituted by integrally incorporating charging means, or cleaning means, developing means, and an electrophotographic photosensitive member as a cartridge unit which is detachably mountable to a main body of the image forming apparatus, or, by integrally incorporating at least one of charging means and cleaning means, developing means and an electrophotographic photosensitive member as a cartridge unit that is detachably mountable to a main body of the image forming apparatus, or by integrally incorporating developing means and an electrophotographic photosensitive member as a cartridge unit that is detachably mountable to a main body of the image forming apparatus.

2. Related Background Art

In the past, as one of electrophotographic image forming apparatuses, there has been proposed an image forming apparatus to which a developing device or a process cartridge can be detachably mounted. The developing device or the process cartridge comprises a toner container (developer container) for containing toner (developer), and a developing chamber including a developing roller as a developer bearing member. When the developer in the toner container is consumed, the developing device or the process cartridge must be replaced by a new developing device or a new process cartridge. To this end, there is provided a developer-remaining-amount detecting device for detecting a remaining amount of the developer in the toner container.

Such a developer-remaining-amount detecting device has a metallic antenna rod extending in parallel with a longitudinal direction of the developing roller and is disposed in a passage extending from the toner container to the developing roller in the developing chamber. By applying a voltage between the antenna rod and the developing roller to measure the electrostatic capacity therebetween, the toner remaining amount can be detected. When the detected electrostatic capacity is smaller than a predetermined threshold value, it is judged that the toner amount between the antenna rod and the developing roller is small, i.e., the toner amount in the toner container is small. By detecting the change in the electrostatic capacity in this way, the absence of toner has been detected.

However, in the conventional toner-remaining-amount detecting devices, the fact that the remaining toner is little can merely be known immediately before the toner is used up, but, the user cannot know how much toner is remaining in the toner container.

SUMMARY OF THE INVENTION

An object of the present invention is to provide a developing device, a process cartridge, an agitating member and an electrophotographic image forming apparatus, in which a toner remaining amount can be detected successively.

Another object of the present invention is to provide a developing device, a process cartridge, an agitating member and an electrophotographic image forming apparatus, in which a toner remaining amount can be detected with high accuracy.

A further object of the present invention is to provide a developing device, a process cartridge, an agitating member and an electrophotographic image forming apparatus, in which a toner remaining amount is detected by using a change in electrostatic capacity.

The other object of the present invention is to provide a developing device, a process cartridge, an agitating member and an electrophotographic image forming apparatus, that have a movable antenna member for detecting a remaining amount of toner remaining in the developing device, which antenna member serves to detect the toner remaining amount on the basis of the change in electrostatic capacity between electrodes provided on the antenna member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

[First Embodiment]

Now, a first embodiment of the present invention will be fully described with reference to the accompanying drawings.

Figure 2B:
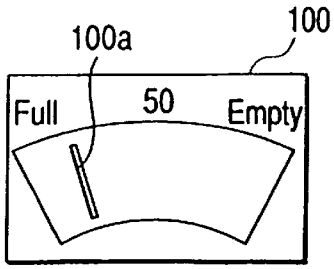
FIG. 2 is a vertical sectional view of an electrophotographic image forming apparatus according to a first embodiment of the present invention.
Figure 2A:
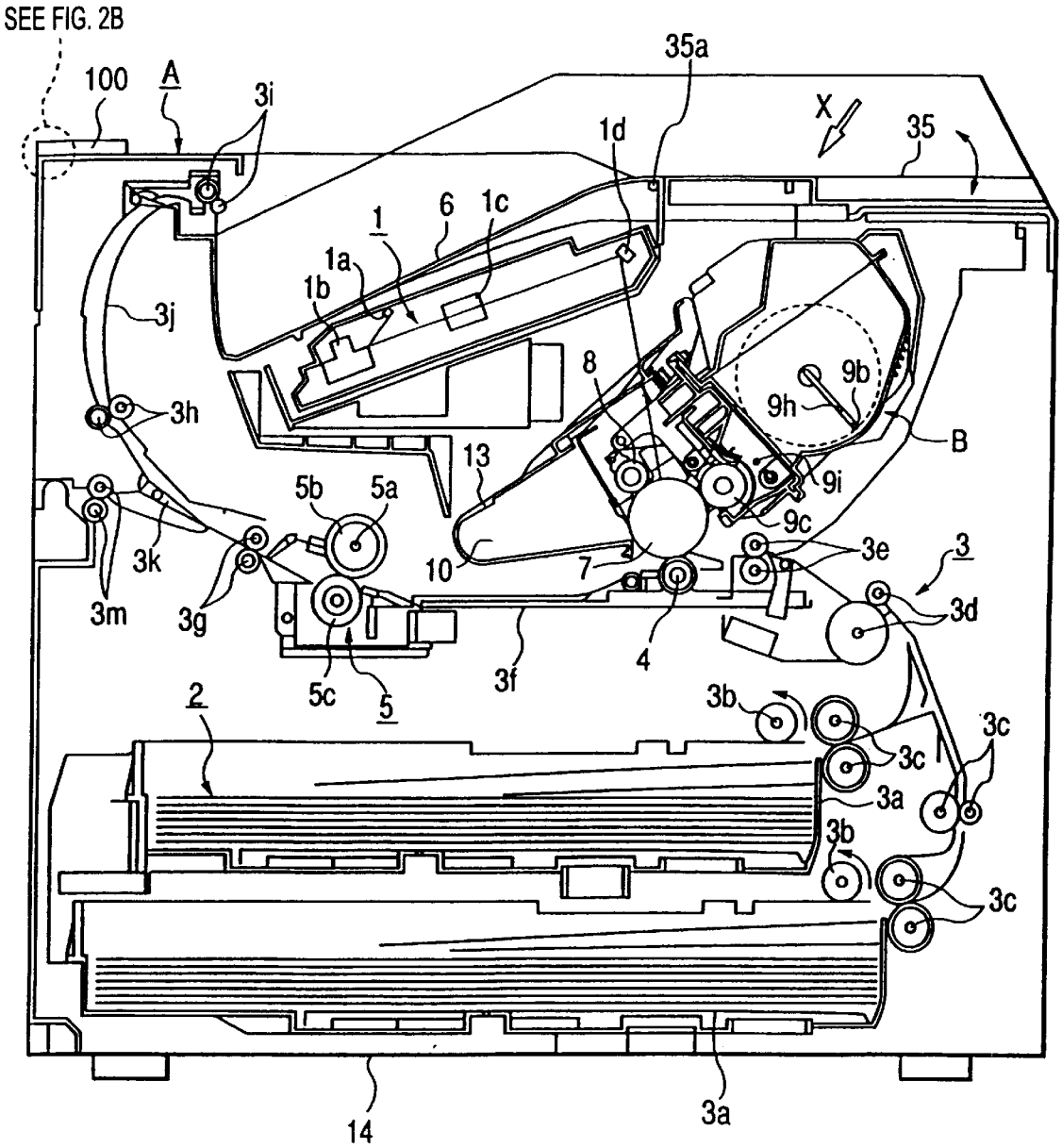
Figure 3:
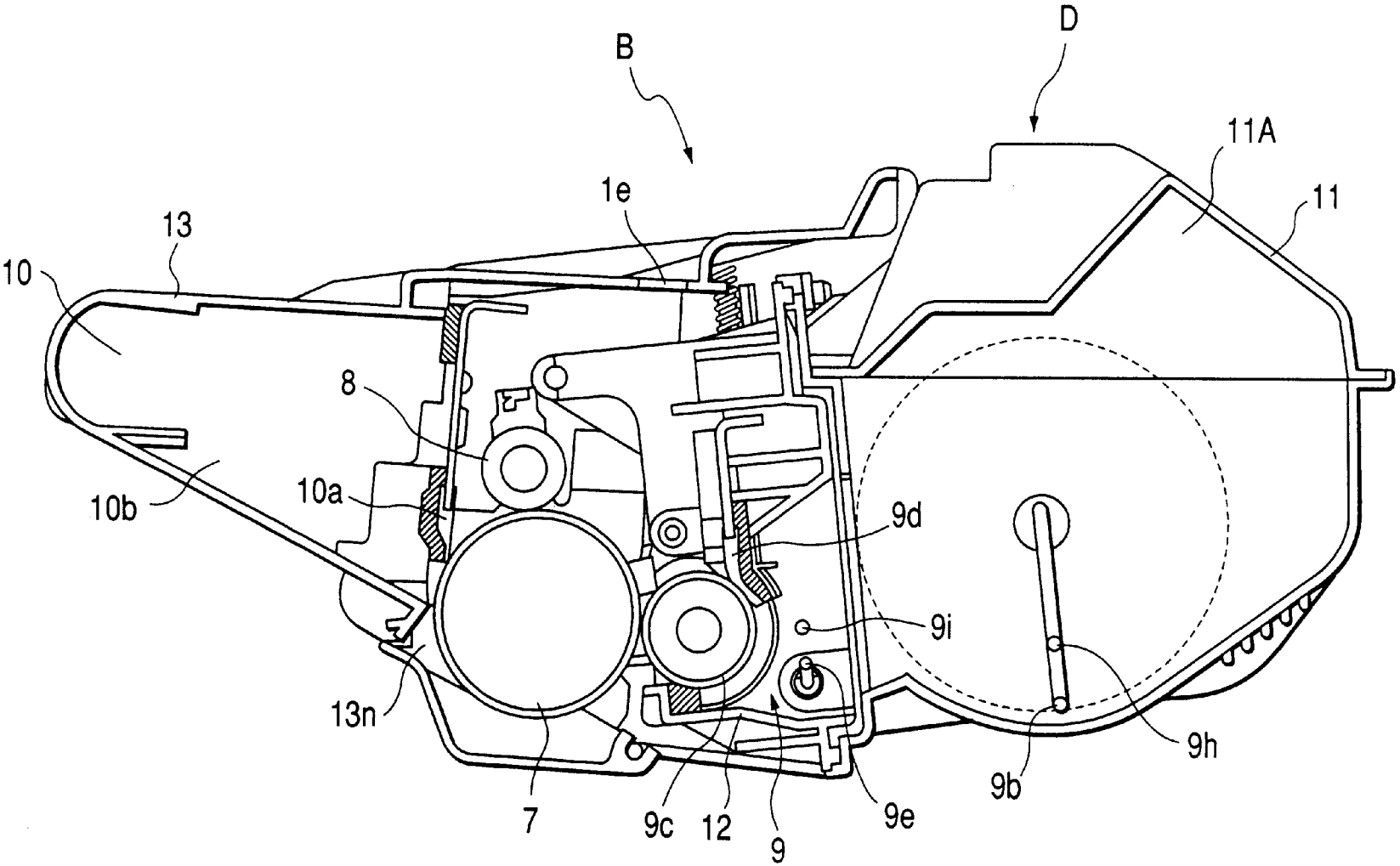
FIG. 3 is a vertical sectional view of a process cartridge detachably mountable to the electrophotographic image forming apparatus according to the first embodiment.

FIG. 2 is a constructural view of an electrophotographic image forming apparatus according to the first embodiment of the present invention, and FIG. 3 is a sectional view of a process cartridge detachably mountable to the electrophotographic image forming apparatus.

[Electrophotographic Image Forming Apparatus A and Process Cartridge B]

First of all, a laser beam printer A as the electrophotographic image forming apparatus according to the first embodiment will be explained with reference to FIGS. 2 and 3.

As shown in FIG. 2, the laser beam printer A serves to form an image on a recording medium (for example, recording paper, OHP sheet, cloth or the like) by using an electrophotographic image forming process. A toner image is formed on a drum-shaped electrophotographic photosensitive member (referred to as "photosensitive drum" hereinafter). More specifically, the photosensitive drum is charged by charging means, and then, a latent image corresponding to image information is formed on the photosensitive drum by illuminating the photosensitive drum with a laser beam corresponding to the image information from optical means 1. The latent image is developed by developing means to form a toner image. In sync with the formation of the toner image, a recording medium 2 is fed from a sheet feeding cassette 3*a* by a pick-up roller 3*b* and is turnover-conveyed by pairs of conveying rollers 3*c*, 3*d* and a pair of registration rollers 3*e*. Then, the toner image formed on the photosensitive drum 7 of a process cartridge B is transferred onto the recording medium 2 by applying voltage to a transfer roller 4 as transferring means. Thereafter, the recording medium 2 on which the toner image was transferred is conveyed to fixing means 5 by a conveying guide 3*f*. The fixing means 5 has a driving roller 5*c*, and a fixing roller 5*b* including a heater 5*a* therein. While the recording medium 2 is being passed through the fixing means 5, heat and pressure are applied to the recording medium 2 so that the transferred toner image is fixed to the recording medium 2. Thereafter, the recording medium 2 is conveyed by pairs of discharge rollers 3*g*, 3*h*, 3*i* and is discharged onto a discharge tray 6 through a turn-over path 3*j*. The discharge tray 6 is provided on an upper surface of a main body 14 of the image forming apparatus A. Incidentally, by driving an oscillatable flapper 3*k*, the recording medium 2 can be discharged by a pair of discharge rollers 3*m* without passing through the turn-over path 3*j*. In the illustrated embodiment, the pick-up roller 3*b*, the pairs of conveying rollers 3*c*, 3*d*, the pair of registration rollers 3*e*, the conveying guide 3*f*, the pairs of discharge rollers 3*g*, 3*h*, 3*i* and the pair of discharge rollers 3*m* constitute conveying means 3. Incidentally, the optical means 1 includes a laser diode 1*a*, a polygon mirror 1*b*, a lens 1*c* and a reflection mirror 1*d*.

On the other hand, as shown in FIG. 3, in the process cartridge B, while the photosensitive drum 7 having a photosensitive layer is being rotated, a surface of the photosensitive drum 7 is uniformly charged by applying voltage to a charging roller (charging means) 8. Then, in response to the image information, a laser beam from the optical means 1 irradiates the photosensitive drum 7 through an exposure opening portion 1*e*, thereby forming the latent image. The latent image is developed by the developing means 9 with toner. That is to say, the charging roller 8 is disposed in contact with the photosensitive drum 7 to charge the photosensitive drum 7. Incidentally, the charging roller 8 is rotatingly driven by rotation of the photosensitive drum 7. Further, the developing means 9 serves to supply the toner to a developing area of the photosensitive drum 7, thereby developing the latent image formed on the photosensitive drum 7.

In the developing means 9, the toner in a toner container 11A is fed out to a developing roller 9*c* by rotation of a toner feeding member 9*b*. While the developing roller 9*c* including a stationary magnet therein is being rotated, a toner layer, to which triboelectric charge is applied by a developing blade 9*d*, is formed on the surface of the developing roller 9*c* and the toner on the developing roller is supplied to the developing area of the photosensitive drum 7. By transferring the toner onto the photosensitive drum 7 in accordance with the latent image, the latent image is visualized as the toner image. The developing blade 9*d* serves to regulate the toner amount around a peripheral surface of the developing roller 9*c* and to apply the triboelectric charge. A toner agitating member 9*e* for circulating the toner in a developing chamber is rotatably supported in the vicinity of the developing roller 9*c*.

After the toner image formed on the photosensitive drum 7 is transferred to the recording medium 2 by applying voltage having a polarity opposite to a polarity of the toner image to the transfer roller 4, residual toner remaining on the photosensitive drum 7 is removed by cleaning means 10. In the cleaning means 10, the residual toner remaining on the photosensitive drum 7 is scraped off by an elastic cleaning blade 10*a* abutting against the photosensitive drum 7, and the scraped toner is collected into a removed-toner reservoir 10*b*.

The process cartridge B is constituted by joining a toner frame 11 having the toner container (toner containing portion) 11A containing the toner to a developing frame 12 holding the developing means 9 such as the developing roller 9*c* and by joining thereto a cleaning frame 13 including the photosensitive drum 7, the cleaning means 10, such as the cleaning blade 10*a,* and the charging roller 8. The process cartridge B can be mounted and dismounted with respect to the main body 14 of the image forming apparatus by the operator. Regarding the mounting/dismounting of the process cartridge B with respect to the main body 14 of the image forming apparatus, in FIG. 2, after an openable and closable member 35 is opened upwardly around hinges 35*a*, the process cartridge can be mounted along a direction shown by the arrow X and can be dismounted along a direction opposite to the direction X.

The process cartridge B is provided with the exposure opening portion 1*e* through which the light corresponding to the image information illuminate the photosensitive drum 7, and a transfer opening portion 13*n* through which the photosensitive drum 7 is opposed to the recording medium 2. The exposure opening portion 1*e* is formed in the cleaning frame 13.

Next, a housing of the process cartridge B according to the first embodiment will be described.

In the process cartridge B shown in the first embodiment, the photosensitive drum 7, the charging roller 8, the developing means 9 and the cleaning means 10 are contained in a housing obtained by integrally joining the toner frame 11, the developing frame 12 and the cleaning frame 13, as a cartridge. The process cartridge B is detachably mounted to cartridge-mounting means provided in the main body 14 of the image forming apparatus.

[Housing of Process Cartridge B]

In the process cartridge B according to the first embodiment, as mentioned above, the housing is constituted by joining the toner frame 11, the developing frame 12 and the cleaning frame 13. Now, the toner frame 11 and the developing frame 12 will be explained.

Figure 1:
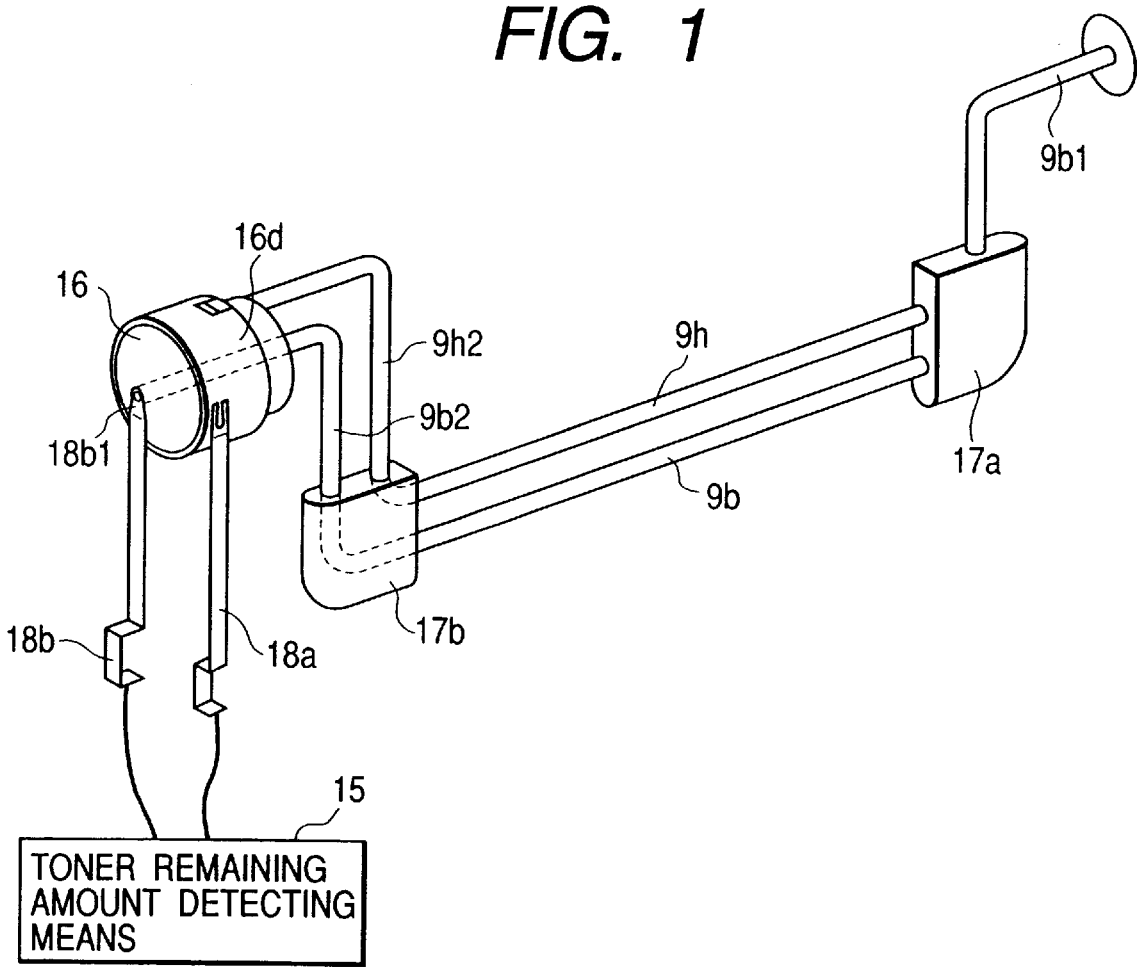
FIG. 1 is a perspective view showing the positional relationship between a toner feeding member and a first antenna rod, and toner-remaining-amount detecting means, according to a first embodiment of the present invention.

As shown in FIG. 3, the toner feeding member 9*b* is rotatably attached to the toner frame 11. Further, as shown in FIGS. 1 to 3, a first antenna rod 9*h* extending substantially in parallel with the toner feeding member 9*b* is attached to the toner frame 11 along a longitudinal direction of the toner feeding member 9*b*. Further, the developing roller 9*c*, the developing blade 9*d* , and a second antenna rod 9*i* are attached to the developing frame 12, and the agitating member 9*e* for circulating the toner in the developing chamber is rotatably supported in the vicinity of the developing roller 9*c* . An integral developing unit (second frame) D is formed by welding (ultrasonic welding in the illustrated embodiment) the toner frame 11 and the developing frame 12 together.

[Toner Remaining Amount Detecting Member]

FIG. 1 shows the positional relationship between the toner feeding member 9*b* and the first antenna rod 9*h*, and toner-remaining-amount detecting means 15. Incidentally, in FIG. 1, a helical gear of a support member 16, a shaft sealing portion 16*i* and a toner-feeding-member driving portion 16*j,* which will be described later, are omitted from illustration for clarify's sake.

As shown in FIG. 1, the first antenna rod 9*h* is integrally attached to the toner feeding member 9*b* formed as a crank shape with a predetermined distance therebetween.

The distance may be selected within a detectable range and so as not to clog the toner between the antenna rod and the toner feeding member and is suitably 5.5 mm to 9 mm.

The toner feeding member 9*b* is formed from a rod or a plate-shaped member made of non-magnetic metal, such as stainless steel, and is formed in the shape of a crank. One end 9*b*1 of the toner feeding member 9*b* is rotatably supported in a recessed portion formed in the toner frame 11 and the other end is supported by the support member 16 rotatably supported by the toner frame 11. The first antenna rod 9*h* has one end attached to the toner feeding member 9*b* via a holder 17*a* and the other end supported by the support member 16. Further, as shown in FIG. 1, the first antenna rod 9*h* is attached to the toner feeding member 9*b* by another holder 17*b* to maintain the distance with respect to the toner feeding member 9*b*.

Figure 5B:
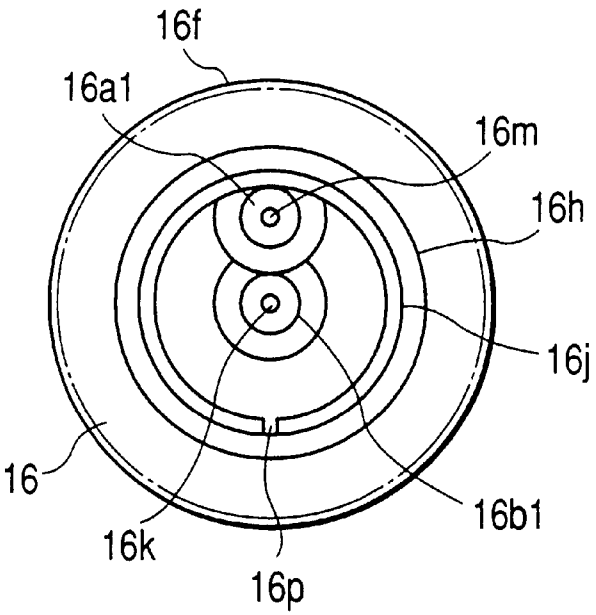
FIG. 5B is a right side view of FIG. 5A.
Figure 5A:
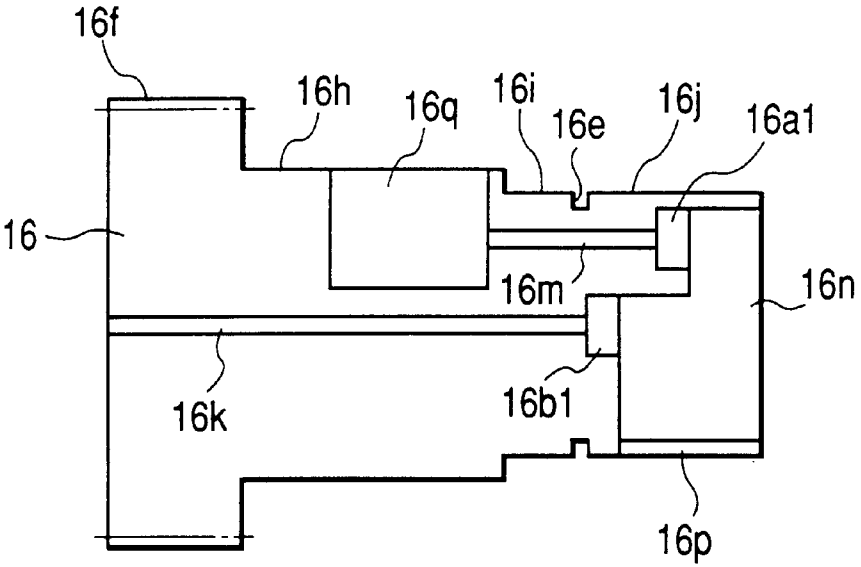
FIG. 5A is a schematic vertical sectional view of a support member.
Figure 6:
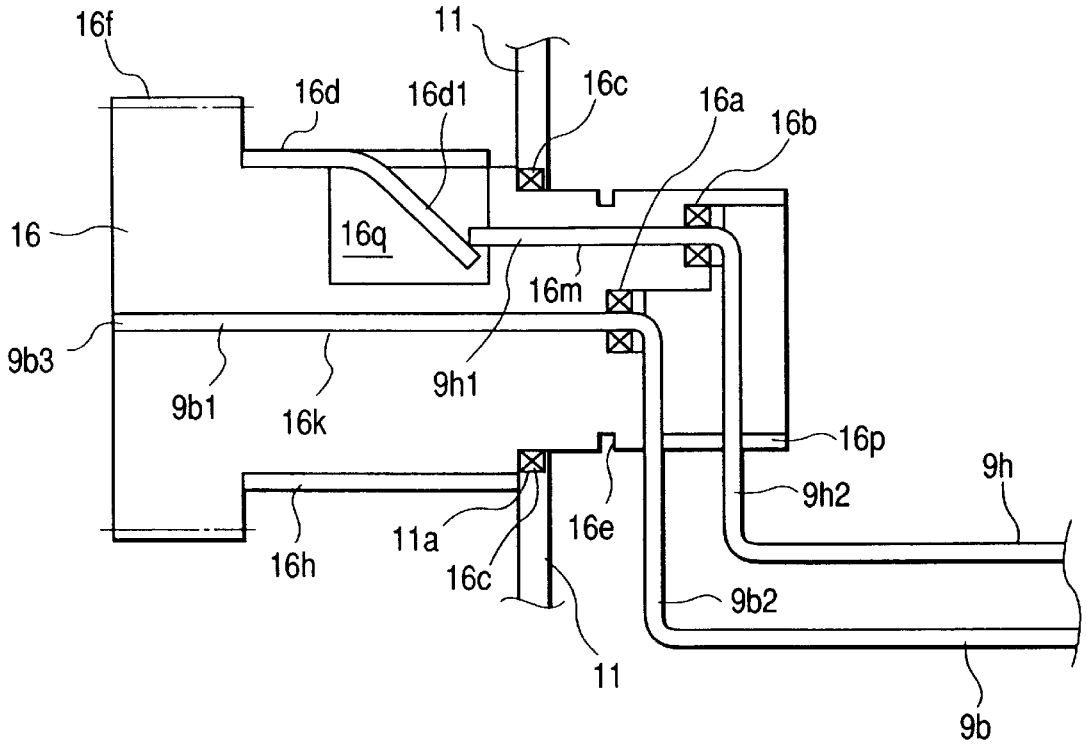
FIG. 6 is a vertical sectional view showing the state in which a toner feeding member, an antenna rod and a contact member are attached to the support member.
Figure 7:
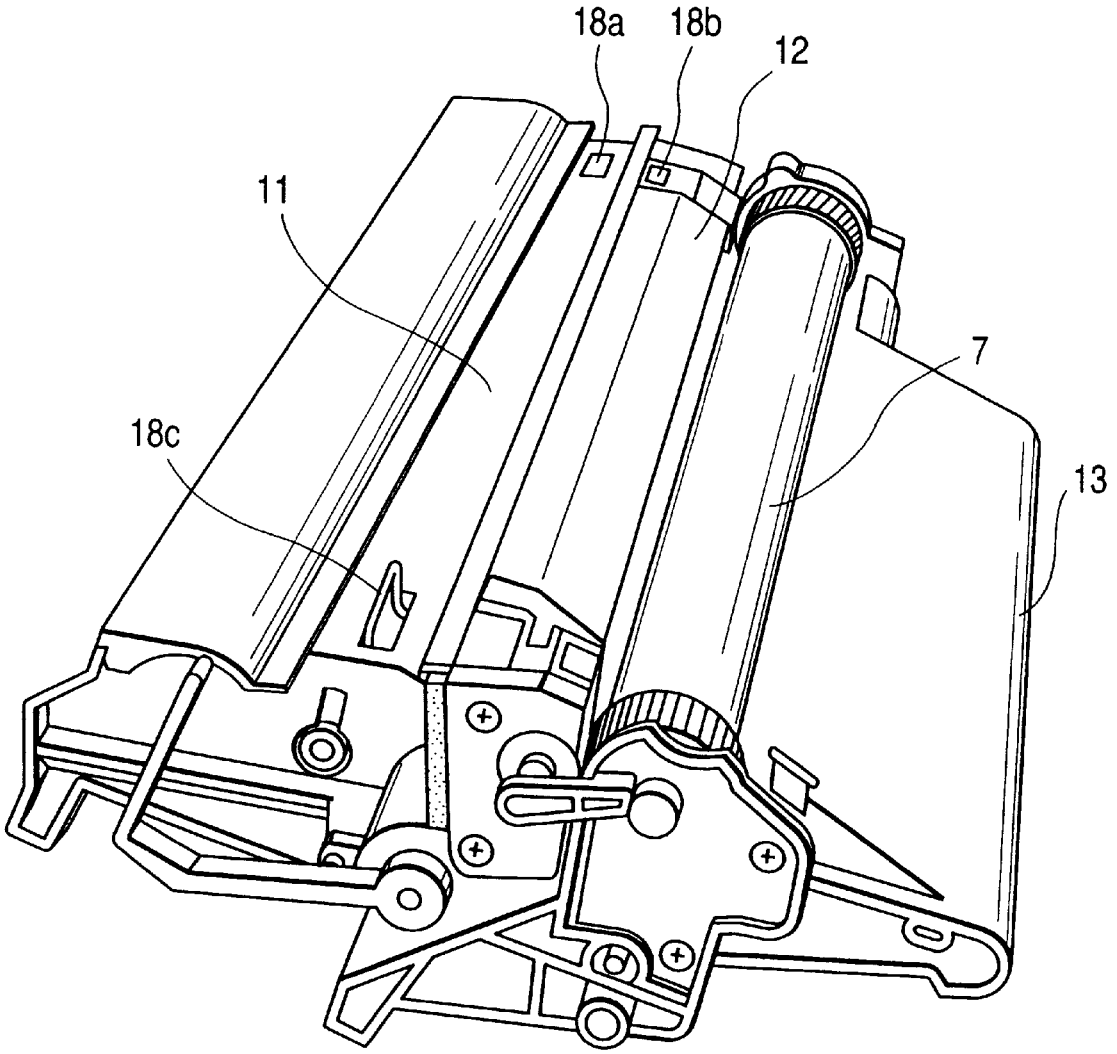
FIG. 7 is a perspective view of a process cartridge according to first and second embodiments of the present invention.

FIG. 5A is a vertical sectional view of the support member 16, and FIG. 6 is a sectional view showing a state in which the toner feeding member 9*b*, the first antenna rod 9*h*, a contact member 16*d* and toner seal members 16*a*, 16*b*, 16*c* are attached to the support member 16. Further, FIG. 7 is a perspective view of the process cartridge according to the first embodiment, as viewed from below.

The support member 16 shown in FIGS. 5A and 5B has a helical gear 16*f*, a contact member support portion 16*h*, a journal-cum-sealing portion 16*i*, and a toner-feeding-member driving portion 16*j*. The contact-member support portion 16*h* is provided with a rectangular recessed portion 16*q* extending radially from an outer periphery of the support portion 16*h*. The toner feeding member driving portion 16*j* is provided at its outer periphery with a circumferential groove portion 16*e*. A fitting through hole 16*k* for the toner-feeding member 9*b* is formed in the support member 16 at a center of the support member 16. An antenna rod fitting hole 16*m* is extending through the support member 16 from an inner side (right in FIG. 5A) to the recessed portion 16*q* in parallel with the hole 16*k*. Inlets of the holes 16*k,* 16*m* at the inner side have enlarged diameter portions to provide seal-member fitting holes 16*a*1, 16*b*1.

The support member 16 is provided at its end of the inner side with a hollow portion 16*n* at a center thereof, and the fitting holes 16*k,* 16*m* extend to the left (FIG. 5A) from a bottom of the hollow portion 16*n*. A peripheral wall of the hollow portion 16*n* is provided with a radially running through slot 16*p* into which an arm portion 9*b*2 of the toner-feeding member 9*b* and an arm portion 9*h*2 of the first antenna rod 9*h* are just fitted.

As shown in FIG. 6, a shaft end portion 9*b*l of the toner-feeding member 9*b* is fitted into the fitting hole 16*k* of the support member 16. The arm portion 9*b*2 of the toner feeding member 9*b* is fitted into the slot 16*p* of the support member 16. Further, the shaft end portion 9*h*1 of the first antenna rod 9*h* is fitted into the fitting hole 16*m* of the support member 16. The arm portion 9*h*2 of the first antenna rod 9*h* is fitted into the slot 16*p* of the support member 16. The toner-feeding-member 9*b* and the first antenna rod 9*h* are designed so that they are fitted from the right toward the left in FIG. 6. And, the member 9*b* and the rod 9*h* are sealed by the toner seal members 16*a*, 16*b* previously fitted in the toner-seal fitting holes 16*a*1, 16*b* 1. Further, a hollow cylindrical contact member 16*d* having an incised contact portion 16*d*1 formed in a part of the circumference of the contact member 16*d* is also previously fitted into the contact-member support portion 16*h* of the support member 16 so that the incised contact portion 16*d*1 is lightly bent in the recess portion 16*q* of the support member 16 to provide the contact portion 16*d*1. The shaft end portion 9*h*1 of the first antenna rod 9*h* is inserted into the fitting hole 16*m* to urge the bent contact portion 16*d*1 so that the bent contact portion 16*d*1 of the contact member 16*d* elastically urges the end surface of the first antenna rod 9*h* to thereby make a reliable electrical connection.

The toner-feeding member 9*b* is attached to extend through the fitting hole 16*k* of the support member 16, so that an end portion 18*b*1 (FIG. 1) of the contact member 18*b* provided on the toner frame 11 elastically urges an exposed end surface 9*b*3 of the toner-feeding member 9*b* to thereby make a reliable electrical connection.

The support member 16 is constructed as mentioned above and is attached to the toner frame 11 in a unit. In this case, in order to prevent toner from leaking out, the toner-seal member 16*c* is fitted into and secured to the hole 11*a* of the toner frame 11 between the toner frame 11 and the journal-cum-sealing portion 16*i* of the support member 16. Dislodgment-preventing members or detent members (E type retaining rings in the illustrated embodiment) (not shown) for preventing the support member 16 from coming off from the toner frame 11 are disposed in the groove portion 16*e*.

Further, the support member 16 is provided at its end with the helical gear 16*f*, which is rotatingly driven by a driving source (not shown). Thus, the support member 16 is biased in an axial direction (right) of a rotational shaft by a thrust force from the helical gear 16*f* to thereby further effectively prevent the support member 16 from coming off.

Further, as shown in FIG. 1, along the toner frame 11, there are provided a contact member 18*a* contacting a part of an outer periphery of the contact member 16*d* and acting as a contact, and a contact member 18*b* contacting the end surface of the toner-feeding member 9*b* and acting as a contact. As shown in FIG. 7, parts of the contact members 18*a*, 18*b* are exposed from the bottom surface (along which the recording medium passes) of the toner frame 11 so that, when the process cartridge is mounted to the main body 14 of the image forming apparatus, the contact members 18*a*, 18*b* contact contacts (not shown) of the main body of the image forming apparatus, thereby providing electrical connection. Through these contacts, bias is applied to the toner feeding member 9*b*.

[Toner-remaining-amount Detecting Mechanism]

Next, a toner-remaining-amount detecting mechanism regarding the first antenna rod 9*b* of the process cartridge B according to the illustrated embodiment will be explained.

As shown in FIGS. 1 and 3, the process cartridge B according to the illustrated embodiment includes the first antenna rod 9*h* extending substantially in parallel with the toner-feeding member 9*b* and integrally attached to the toner-feeding member 9*b* and adapted to detect the amount of toner between the toner feeding member 9*b* and the antenna rod 9*h*. The first antenna rod 9*h* serves to detect the amount of toner between the toner-feeding member 9*b* and the antenna rod 9*h* successively and forms a part of the toner-remaining-amount detecting means 15.

Now, the toner-remaining-amount detecting means 15 having the first antenna rod 9*h* will be fully explained. The toner-remaining-amount detecting means 15 is provided in the main body 14 of the image forming apparatus.

The toner-remaining-amount detecting means 15 is operated every about 10 msec to detect the toner remaining amount between the toner-feeding member 9*b* and the first antenna rod 9*h*.

Figure 4:
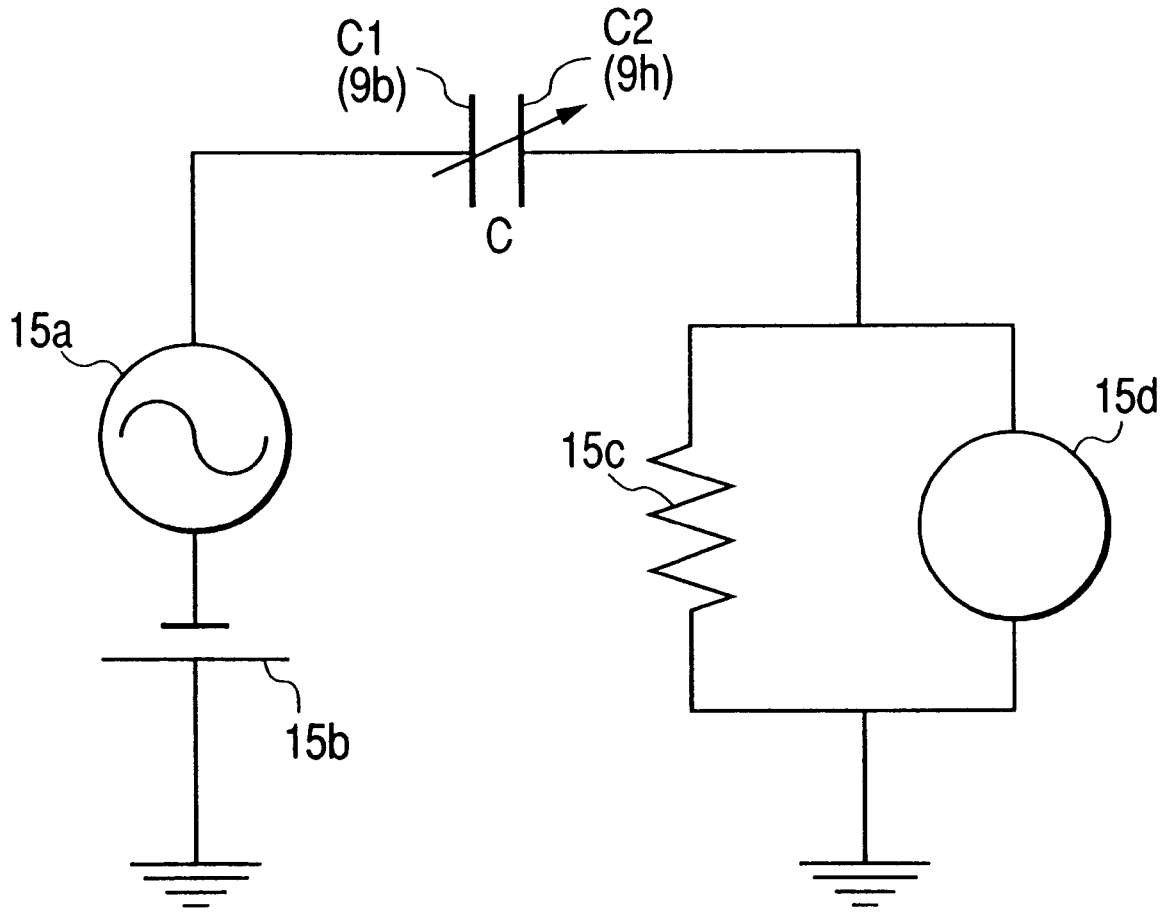
FIG. 4 is a schematic view showing an equivalent circuit for the toner remaining detection.

That is to say, the toner-remaining-amount detecting means 15 detects the electrostatic capacity between the toner-feeding member 9*b* to which the developing bias is being applied and the first antenna rod 9*h* and estimates the toner-remaining-amount in the toner container 11A on the basis of the value of the detected electrostatic capacity. As shown in FIG. 4, the toner-remaining-amount detecting means 15 mainly includes a load-resistor 15*c* and a voltmeter 15*d*.

Now, an equivalent circuit will be explained with reference to FIG. 4.

An AC power source 15*a* and a DC power source 15*b* are connected to the toner-feeding member 9*b* so that an electric current obtained by superposing an alternate current on a direct current flows through the toner-feeding member 9*b*. The toner-feeding member 9*b* assumes a first electrode C1 and the first antenna rod 9*h* opposed to the toner-feeding member 9*b* assumes a second electrode C2 thereby to provide a capacitor C.

In such an equivalent circuit, the electrostatic capacity of the capacitor C is varied with a dielectric constant between the electrodes C1 and C2. The dielectric constant is changed in accordance with the amount of toner between the toner-feeding member 9*b* and the first antenna rod 9*h*. Accordingly, the magnitude of the differential waveform of AC components of the developing bias generated on both ends of the load-resistor 15*c* of the toner-remaining-amount detecting means 15 is varied in accordance with a change in the toner amount between the toner feeding member 9*b* and the first antenna rod 9*h*, so that, by measuring such a signal by the voltmeter 15*d*, the toner-remaining-amount in the toner container 11A can be detected.

Next, the change in electrostatic capacity between the toner-feeding member 9*b* and the first antenna rod 9*h* detected in this way will be fully described.

FIGS. 8A and 8B through FIGS. 11A and 11B show processes in which the toner in the process cartridge B according to the first embodiment is gradually consumed; in particular, FIGS. 8B, 9B, 10B and 11B are graphs showing the relationship between the electrostatic capacity between the toner-feeding member 9*b* and the first antenna rod 9*h* (ordinate) and the used time of the process cartridge B (abscissa) in each process.

Figure 8A:
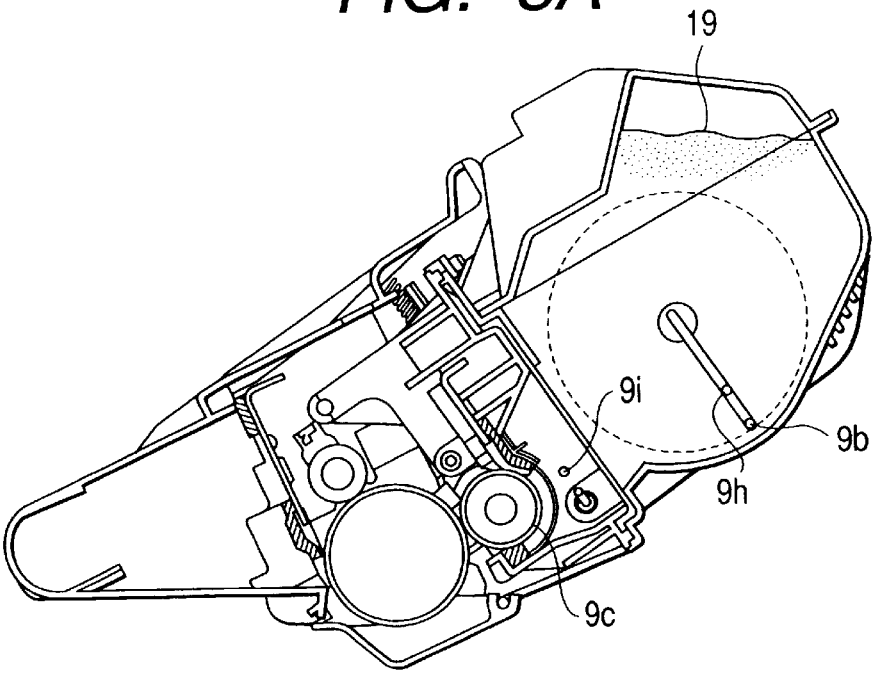
FIG. 8A is a vertical sectional view showing the state of toner in the process cartridge according to the first embodiment.
Figure 8B:
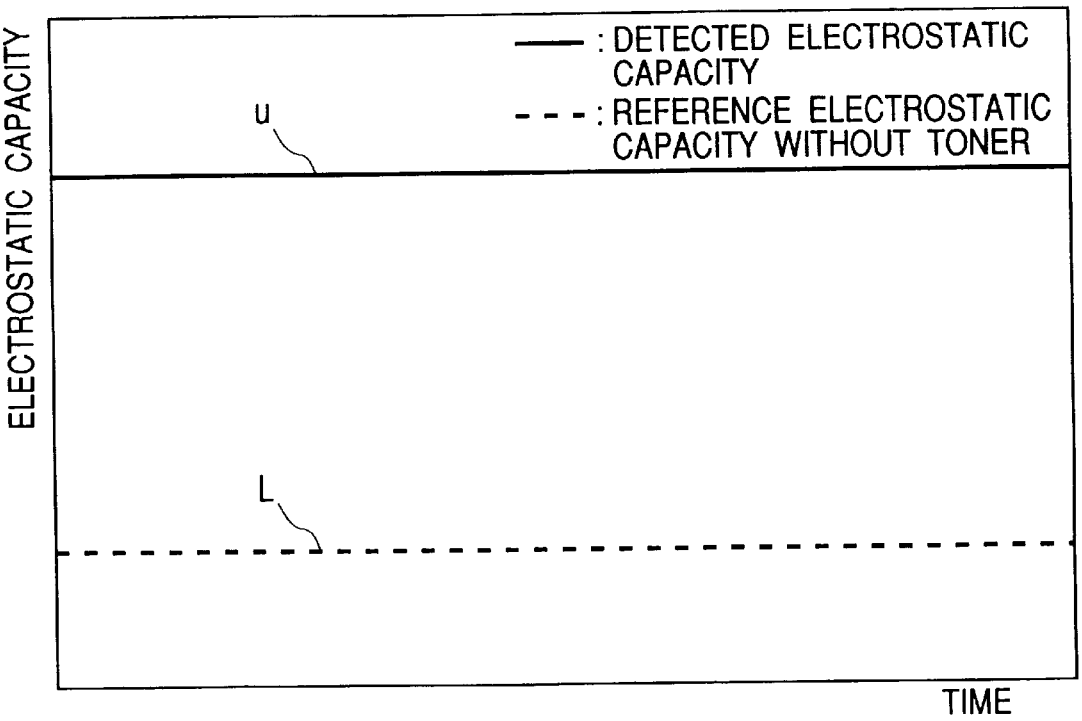
FIG. 8B is a graph showing electrostatic capacity between the toner feeding member and the antenna rod in the state of FIG. 8A.

As shown in FIG. 8A, when an upper surface 19 of the toner is located above a rotating area of the toner feeding member 9*b*, the toner always exists between the toner-feeding member 9*b* and the first antenna rod 9*h* so that the electrostatic capacity does not change as shown the straight line u in FIG. 8B.

Figure 9A:
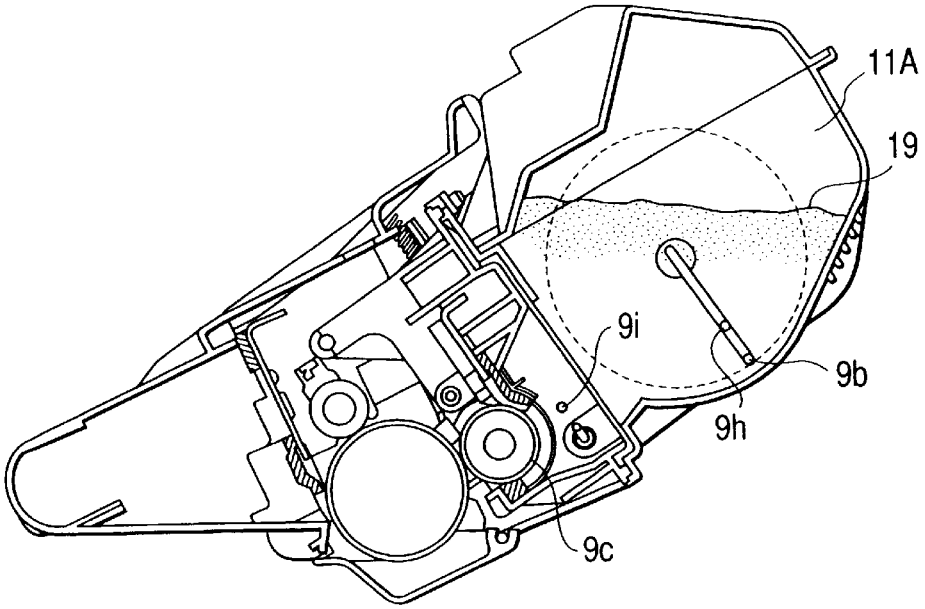
FIG. 9A is a vertical sectional view showing the state of toner in the process cartridge according to the first embodiment.
Figure 9B:
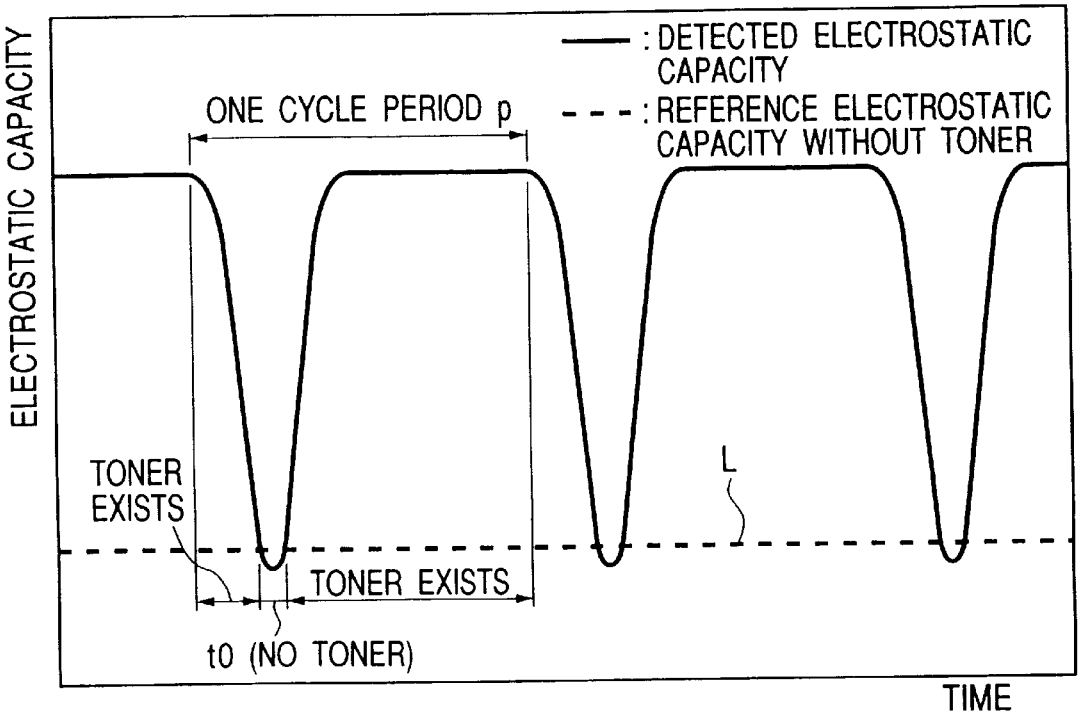
FIG. 9B is a graph showing the electrostatic capacity between the toner feeding member and the antenna rod in the state of FIG. 9A.
Figure 10A:
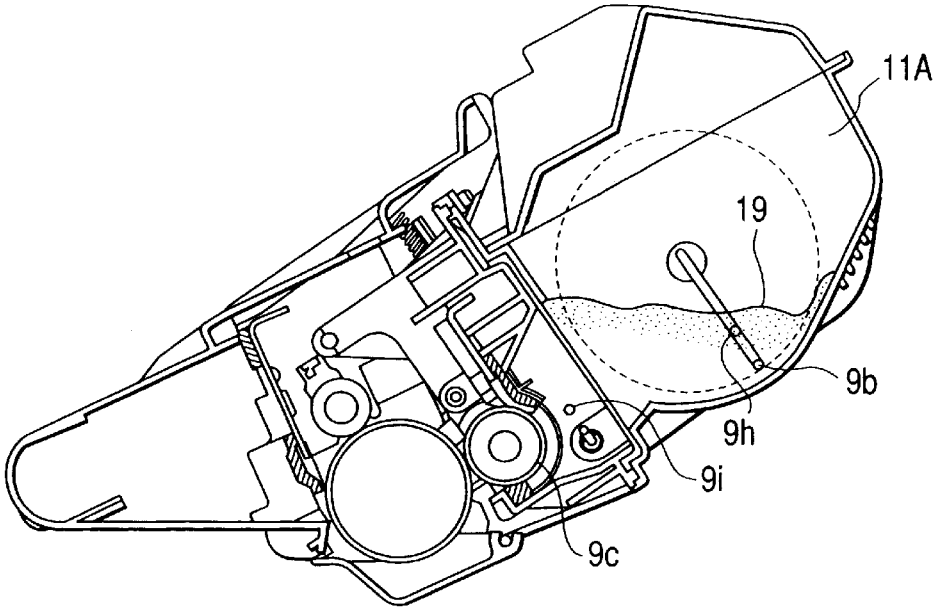
FIG. 10A is a vertical sectional view showing the state of toner in the process cartridge according to the first embodiment.
Figure 10B:
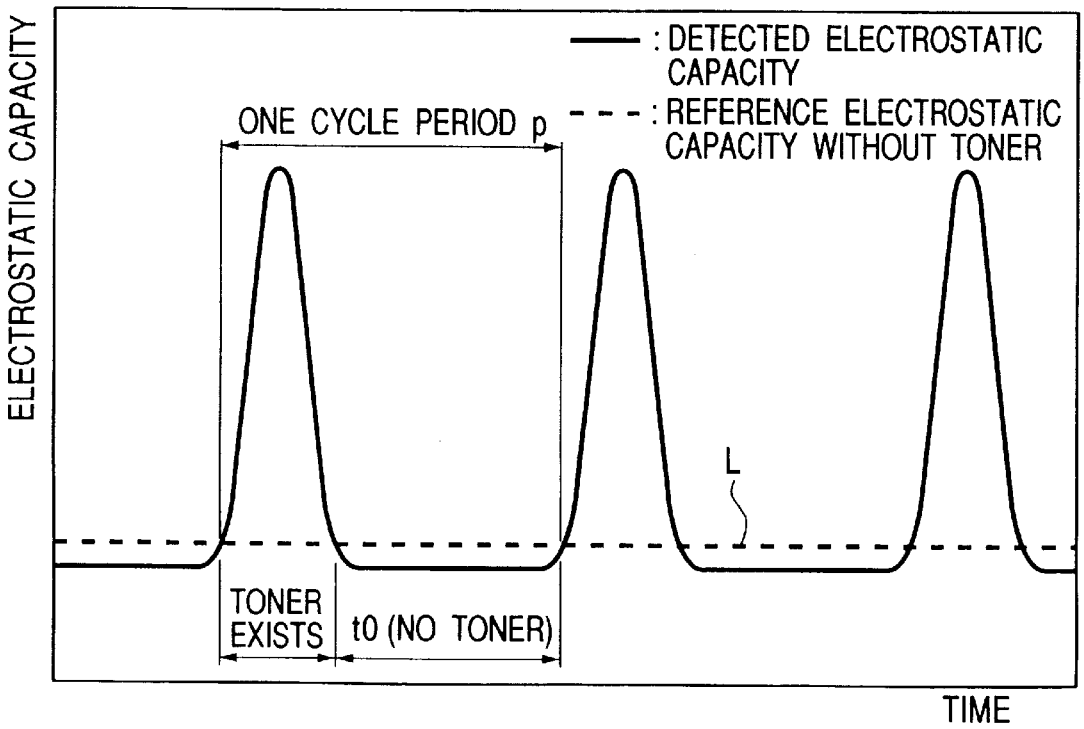
FIG. 10B is a graph showing the electrostatic capacity between the toner feeding member and the antenna rod in the state of FIG. 10A.

The toner-feeding member 9*b* and the first antenna rod 9*h* are rotated simultaneously. As shown in FIGS. 9A and 10A, in the case where the toner upper surface 19 is located within the rotating area of the toner-feeding member 9*b*, a state in which the toner exists between the toner feeding member 9*b* and the first antenna rod 9*h* when the toner feeding member 9*b* and the first antenna rod 9*h* are below the toner upper surface 19 and a state in which the toner does not exist between the toner-feeding member 9*b* and the first antenna rod 9*h* when the toner feeding member 9*b* and the first antenna rod 9*h* are above the toner upper surface 19 are repeated periodically. In this way, the electrostatic capacity detected on the basis of the presence/absence of the toner between the toner-feeding member 9*b* and the first antenna rod 9*h* is periodically changed over a cycle period p. As the toner is gradually consumed, in one cycle period p, a time period t0 of the electrostatic capacity indicating the absent of toner (no toner) (value below the broken line L in FIGS. 9B and 10B) is gradually lengthened.

Figure 11A:
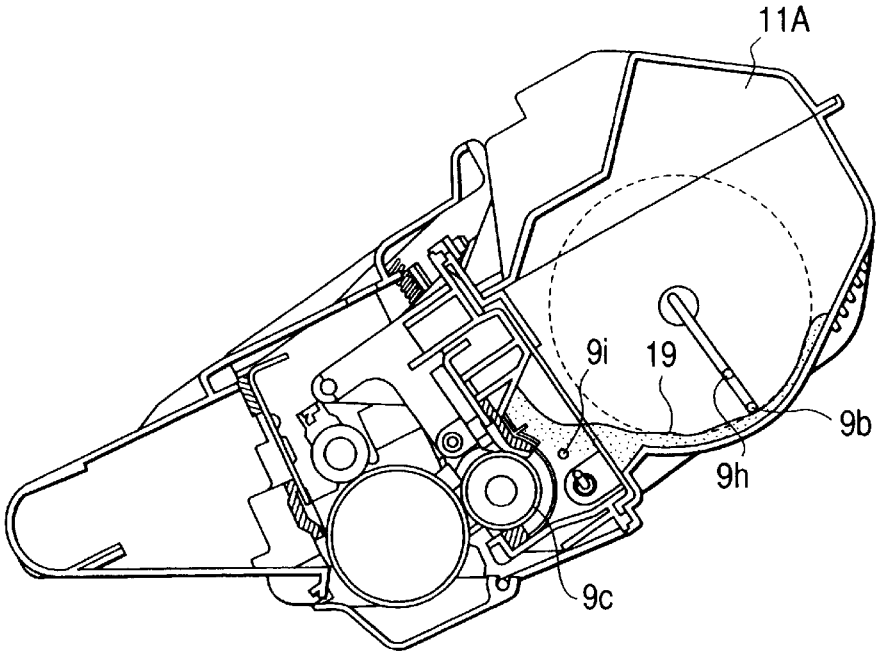
FIG. 11A is a vertical sectional view showing the state of toner in the process cartridge according to the first embodiment.
Figure 11B:
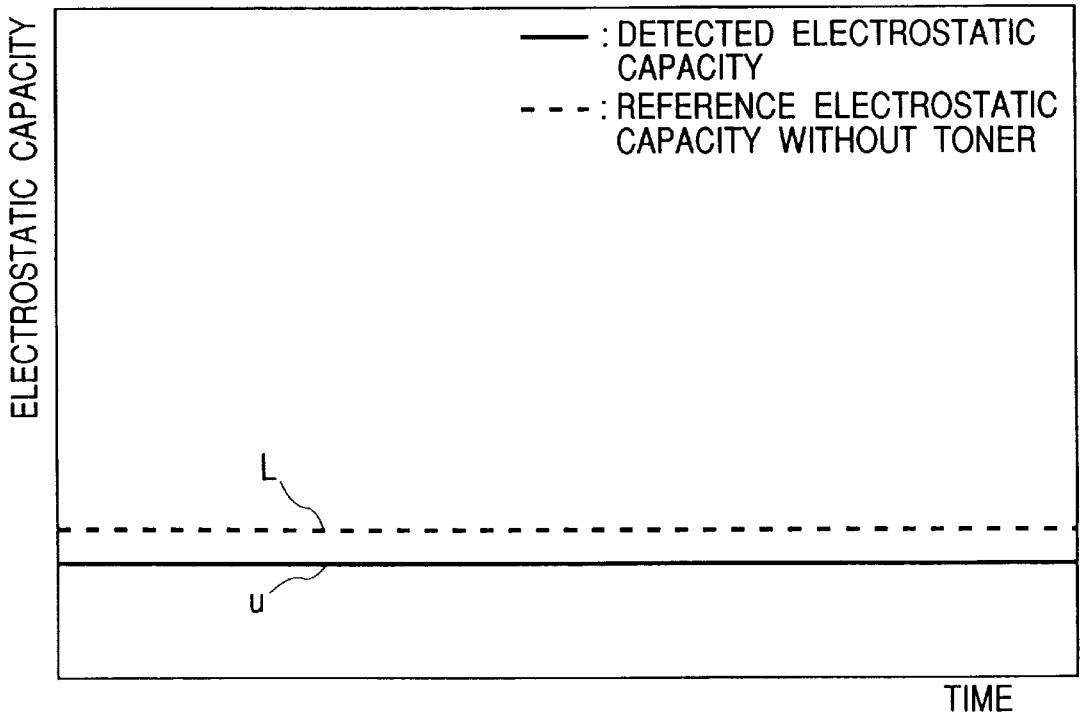
FIG. 11B is a graph showing the electrostatic capacity between the toner feeding member and the antenna rod in the state of FIG. 11A.

And, as shown in FIG. 11A, when the toner is consumed until the toner upper surface 19 reaches below the rotating area of the toner-feeding member 9*b*, the toner does not exist completely between the toner-feeding member 9*b* and the first antenna rod 9*h*, with the result that, as shown in FIG. 11B, the detected electrostatic capacity has always a value indicating no toner and does not change.

That is to say, the toner-remaining-amount in the rotating area of the toner feeding member 9*b* can be successively detected by always monitoring the electrostatic capacity between the toner-feeding member 9*b* and the first antenna rod 9*h*, by dividing the values of the electrostatic capacity on the basis of the period p of rotation of the toner-feeding member 9*b* and by checking the ratio of the time period of the value of the electrostatic capacity indicating no toner (or toner exists) within the period p.

Figure 20:
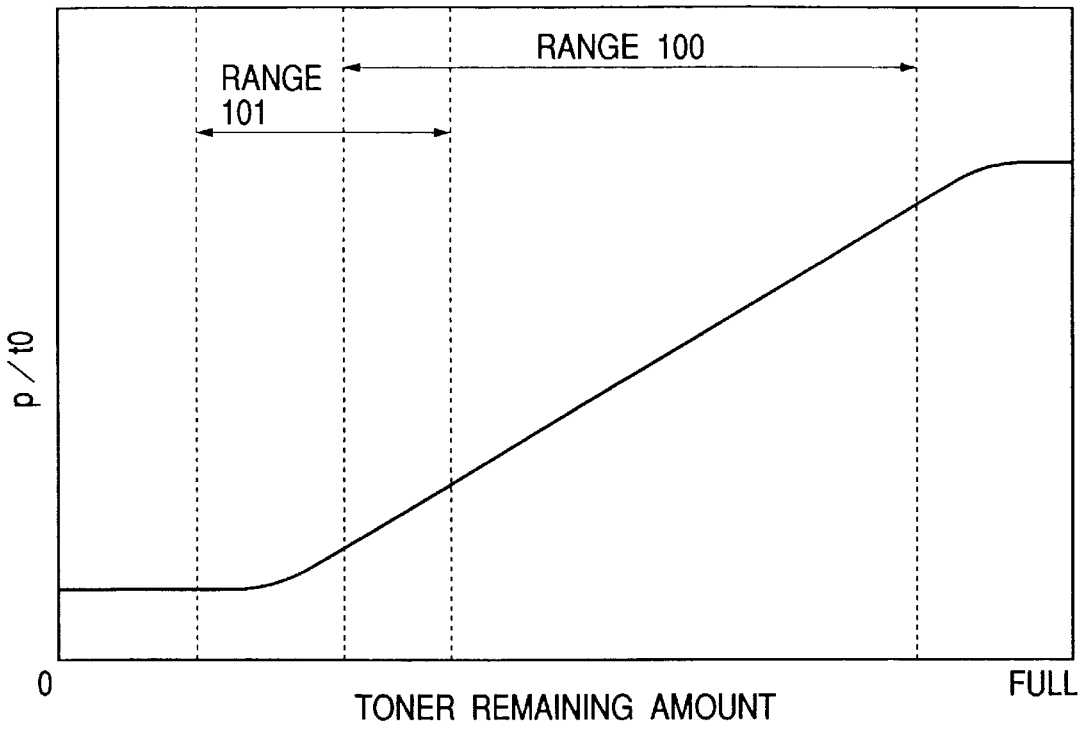
FIG. 20 is a schematic graph showing a relationship between a ratio of cycle period p of rotation to a time t0 at which an electrostatic capacity value indicating no toner is detected, and a toner remaining amount.

FIG. 20 is a schematic view showing the relationship between a ratio of one cycle period p of rotation to a time period for which the electrostatic-capacity value indicating no toner is detected, and the toner-remaining amount. As shown in FIG. 20, in a range 100, the toner-remaining-amount can be successively detected by always monitoring the ratio of p/t0.

Detection of the toner-remaining-amount after the toner in the toner frame 11 was decreased below the rotating area of the toner feeding member 9*b* is effected by using a second antenna rod 9*i* provided in the toner frame 11. Now, a successive toner-remaining-amount detecting mechanism using the second antenna rod 9*i* will be fully explained.

Figure 18:
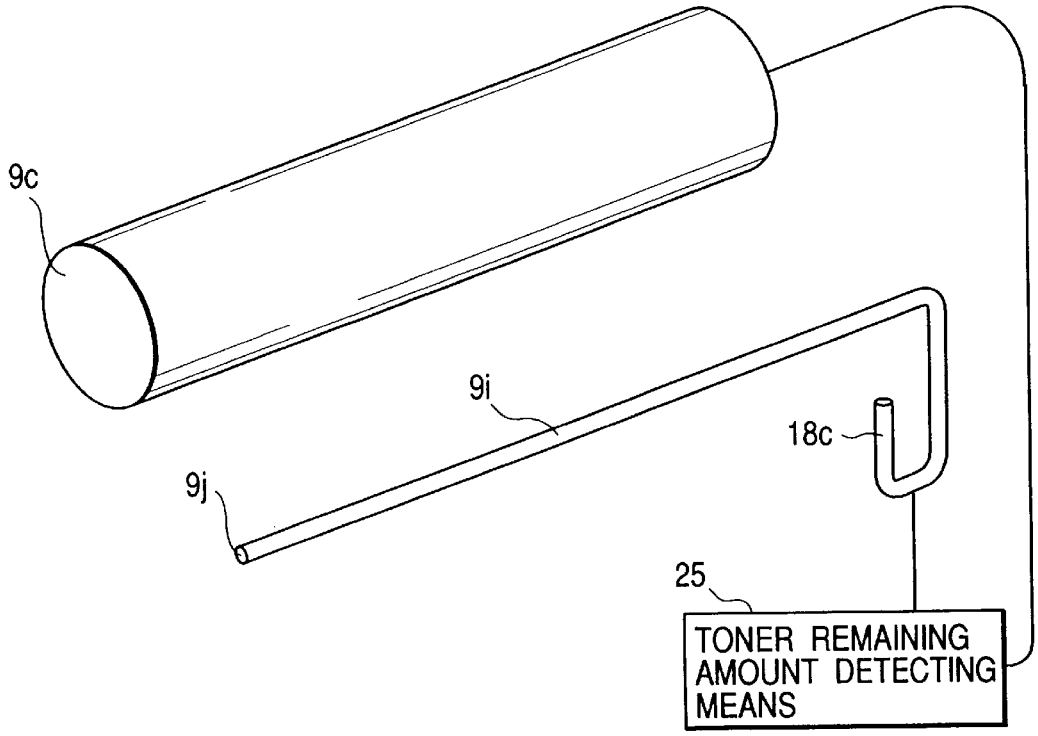
FIG. 18 is a perspective view showing the positional relationship between a developing roller and a second antenna rod, and toner-remaining-amount detecting means, according to the first embodiment.
Figure 19:
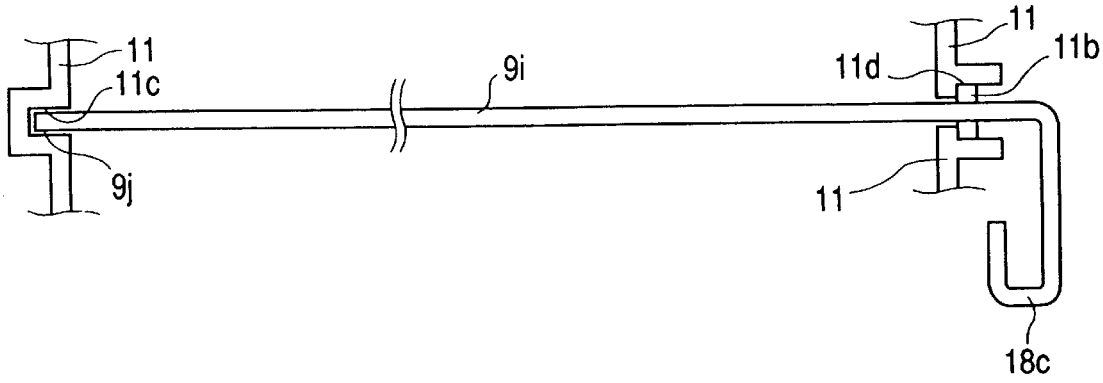
FIG. 19 is a vertical sectional view showing a fixed state of a second antenna rod.

FIG. 18 shows the relationship between the developing roller 9*c* and the second antenna rod 9*i*, and toner-remaining-amount detecting means 25, and FIG. 19 shows a fixing state of the second antenna rod 9*i*.

As shown in FIG. 18, the second antenna rod 9*i* has a bent one end and is attached to the developing frame 12 (not shown here) with a constant distance between the developing roller 9*c* and the second antenna rod 9*i*.

The second antenna rod 9*i* is formed from a rod or a plate-shaped member made of non-magnetic metal, such as stainless steel, and has one end bent in a shape of a hook and attached to the toner frame 11 as shown in FIG. 19. The other end 9*j* of the second antenna rod 9*i* is supported in a recessed portion 11*c* of the toner frame 11, and the one end of the antenna rod 9*i* is secured and sealed by a toner-seal member 11*b* fitted into and attached to an antenna hole lid of the toner frame 11. The toner-seal member 11*b* is formed in a shape of a ring and made of an elastic material, and compressed between the second antenna rod 9*i* and the antenna hole 11*d*.

The bent one end of the second antenna rod 9*i* is located outside the toner frame 11 and forms a contact 18*c* . Namely, as shown in FIG. 7, the contact 18*c* is exposed to the bottom surface (along which the recording medium passes) of the toner frame 11 so that, when the process cartridge B is mounted to the main body 14 of the image forming apparatus, the contact 18*c* contacts a contact (not shown) of the main body 14 of the image forming apparatus, thereby providing an electrical connection. Similarly, the developing roller 9*c* is also provided with a contact (not shown) exposed to the bottom surface of the developing frame 12 so that, when the process cartridge B is mounted to the main body 14 of the image forming apparatus, the contact (not shown) is contacted with a contact (not shown) of the main body 14 of the image forming apparatus, thereby providing an electrical connection. Through these contacts, a developing bias is applied to the developing roller 9*c*, and the second antenna rod 9*i* is connected to the second toner-remaining-amount detecting means 25.

Next, a toner-remaining-amount detecting mechanism for the second antenna rod 9*i* of the process cartridge B according to the illustrated embodiment will be explained.

As shown in FIGS. 3 and 18, the process cartridge B according to the illustrated embodiment is provided with the second antenna rod 9*i* extending substantially in parallel with the developing roller 9*c* and is adapted to detect the amount of toner between the developing roller 9*c* and the second antenna rod 9*i*.

The second antenna rod 9*i* serves to detect the amount of toner between the developing roller 9*c* and the second antenna rod 9*i* and forms a part of the second toner-remaining-amount detecting means 25.

The toner-remaining-amount detecting means 25 of the second antenna rod 9*i* is similar to the above-mentioned first toner-remaining-amount detecting means 15 and serves to detect the toner-remaining amount by detecting the electrostatic capacity between the developing roller 9*c* and the second antenna rod 9*i*.

The electrostatic capacity detected by the second antenna rod 9*i* is varied with the amount of toner between the developing roller 9*c* and the second antenna rod 9*i*. As the toner is gradually decreased between the developing roller 9*c* and the second antenna rod 9*i*, the electrostatic capacity detected by the second antenna rod 9*i* is reduced accordingly, and, when the toner does not exist between the developing roller 9*c* and the second antenna rod 9*i*, the electrostatic capacity does not change from a certain value. That is to say, while the electrostatic capacity detected by the second antenna rod 9*i* is being changed, the amount of toner between the developing roller 9*c* and the second antenna rod 9*i* can be estimated on the basis of the value of the electrostatic capacity, thereby successively detecting the toner-remaining amount between the developing roller 9*c* and the second antenna rod 9*i*.

Figure 21:
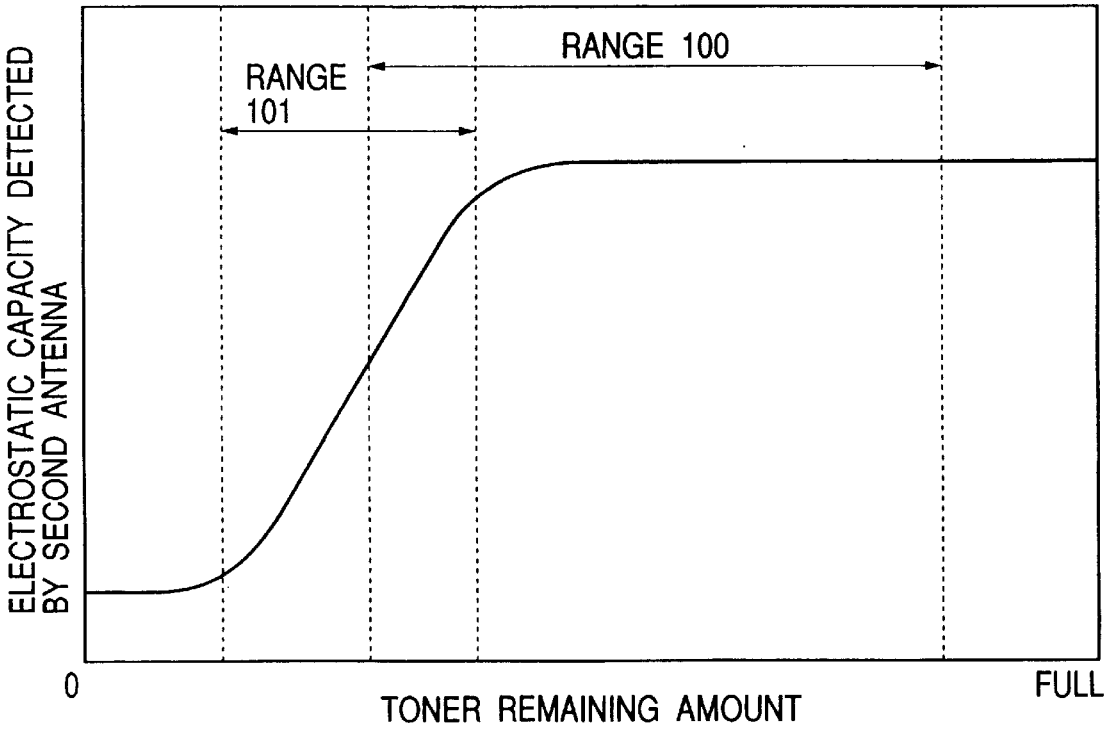
FIG. 21 is a schematic graph showing a relationship between the electrostatic capacity detected between a developing roller 9*c* and a second antenna rod 9*i*, and a toner-remaining-amount.

FIG. 21 is a schematic view showing the relationship between the electrostatic capacity detected between the developing roller 9*c* and the second antenna rod 9*i*, and the toner-remaining-amount. As shown in FIG. 21, in a range 101, the toner-remaining amount can successively be detected by always monitoring the electrostatic capacity detected between the developing roller 9*c* and the second antenna rod 9*i*.

Further, in the illustrated embodiment, the toner-remaining-amount is successively detected substantially throughout the service life of the process cartridge B by using both the first and second antenna rods 9*h*, 9*i*. Such detection is as follows.

The first and second antenna rods 9*h*, 9*i* are positioned so that the ranges 100 and 101 shown in FIGS. 20 and 21 are overlapped without fail.

As shown in FIG. 11A, when the amount of toner in the toner container 11A is decreased below the rotating area of the toner-feeding member 9*b*, the value of the first electrostatic capacity detected by the first antenna rod 9*h* becomes constant.

The main body 14 of the image forming apparatus according to the illustrated embodiment is provided with control means (not shown) for interchanging between the first and second toner-remaining-amount detecting means.

When the fact that the first electrostatic capacity, detected by the first antenna rod 9*h* is not changed periodically, is detected by the control means (not shown) of the main body 14 of the image forming apparatus, the detection system of the toner remaining amount is interchanged, by the control means in a software manner, to the detection of toner-remaining amount effected by using the second electrostatic capacity detected by the second antenna rod 9*i* and the second toner-remaining-amount detecting means 25. After the interchanging, the toner remaining amount is detected by using the second antenna rod 9*i* and the second toner-remaining-amount detecting means 25 as mentioned above.

Naturally, since the respective relationships between the electrostatic capacities obtained from the antenna rods and the toner-remaining amount are not the same, control means (not shown) for calculating the estimated toner-remaining amount based on the detected electrostatic capacity must be interchanged at the same time when the detection system is interchanged to match the corresponding antenna rod. In this case, the interchanging may be effected in a software manner as mentioned above.

As mentioned above, by interchanging the detection system of the toner-remaining amount by using the first and second antenna rods 9*h*, 9*i*, the toner-remaining amount can successively be detected substantially throughout the service life of the process cartridge B.

With the arrangement as mentioned above, the remaining amount of toner in the toner container 11A can successively be detected on the basis of the change in electrostatic capacity between the toner-feeding member 9*b* and the first antenna rod 9*h* and the change in electrostatic capacity between the developing roller 9*c* and the second antenna rod 9*i*, and, thus, by informing the user of the detected toner-remaining amount successively through informing means, such as a monitor, the user can easily know the amount of toner remaining in the process cartridge B. Incidentally, the electrostatic capacity between the developing roller 9*c* and the second antenna rod 9*i* is created by the developing bias applied to the developing roller 9*c*.

In the above-mentioned arrangement, the closer the toner container approaches a cylindrical shape, the greater the effect is achieved.

[Second Embodiment]

Now, a second embodiment of the present invention will be explained with reference to the accompanying drawings. Incidentally, in the second embodiment, since the main constructions of the electrophotographic image forming apparatus and the process cartridge B are the same as those in the first embodiment, an explanation thereof will be omitted.

Figure 12:
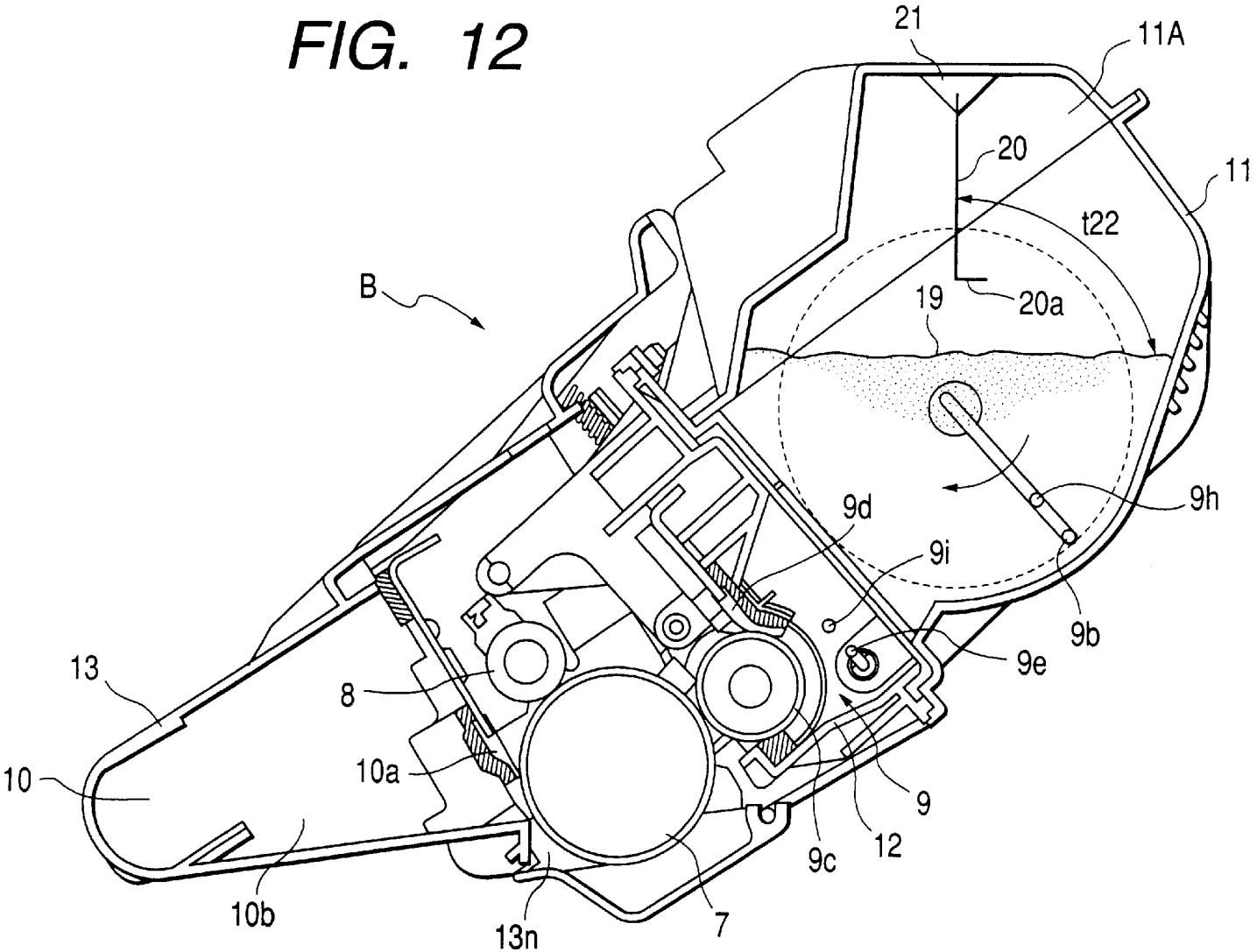
FIG. 12 is a vertical sectional view of a process cartridge according to a second embodiment of the present invention.
Figure 13:
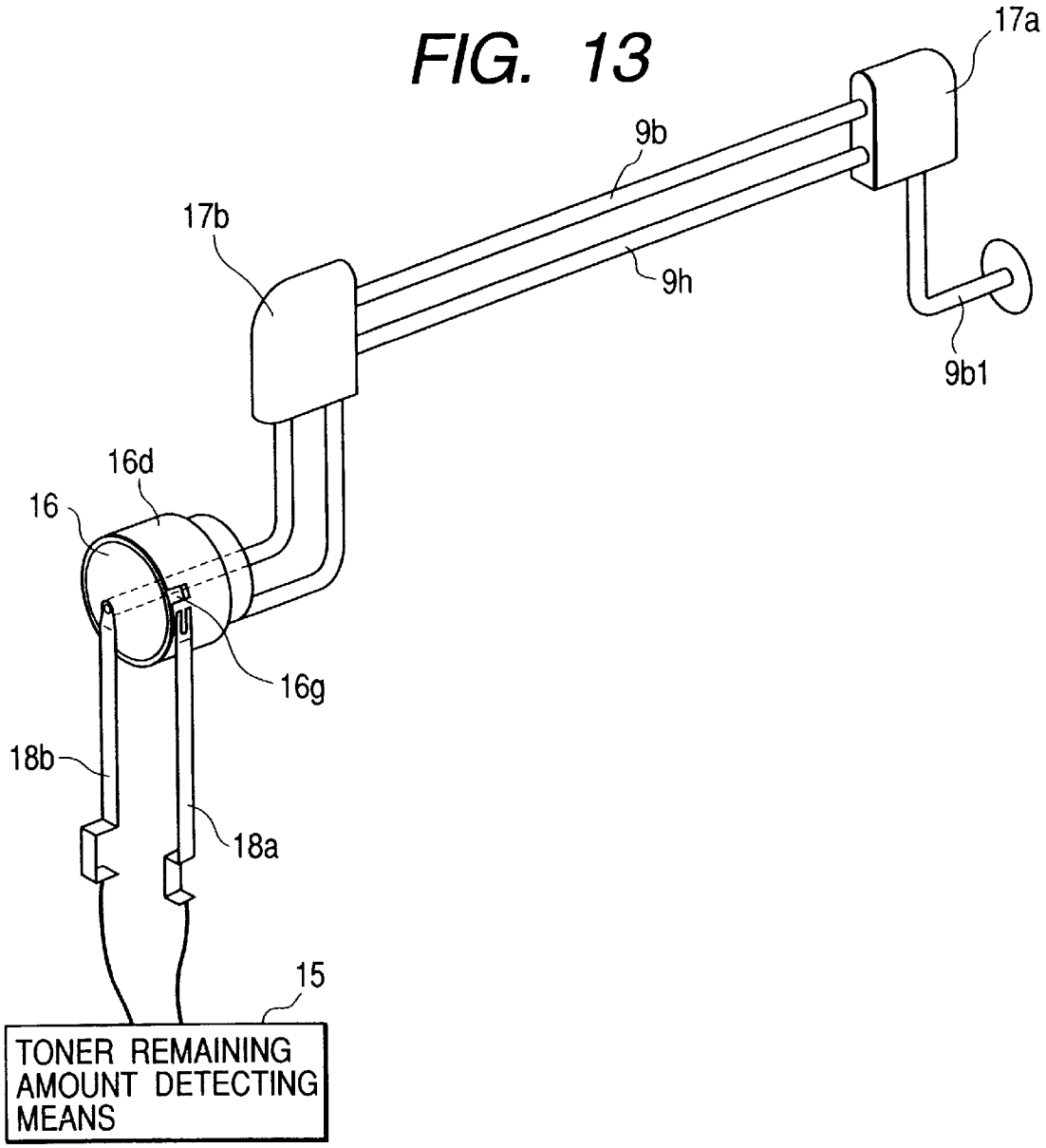
FIG. 13 is a perspective view showing a positional relationship between a toner feeding member and an antenna rod, and toner-remaining-amount detecting means, according to the second embodiment.

FIG. 12 is a sectional view of a process cartridge B according to the second embodiment. Further, FIG. 13 shows the positional relationship between a toner-feeding member 9*b* and a first antenna rod 9*h*, and toner-remaining-amount detecting means 15. Incidentally, a support member 16 is illustrated similar to FIG. 1.

In the first embodiment of the present invention, the distance between the toner-feeding member 9*b* and the first antenna rod 9*h* is widely set not to clog the toner therebetween. However, since the narrower such distance, the greater the change in electrostatic capacity detected by the first antenna rod 9*h*, detecting accuracy is improved accordingly.

Thus, in the second embodiment of the present invention, the distance between the toner-feeding member 9*b* and the first antenna rod 9*h* is decreased as narrow as possible so long as the developing bias applied to the toner feeding member 9*b* does not leak to the first antenna rod 9*h*. Such a distance is preferably about 2 mm to 5.5 mm.

Further, an elastic member (plastic sheet in the illustrated embodiment) 20 having an L-shaped cross-section is disposed within the toner container 11A to be in contact with the toner feeding member 9*b* and the first antenna rod 9*h* at an uppermost position of rotation of the toner-feeding member 9*b*. The elastic member 20 is so located that a distal end 20*a* of the member contacts the toner between the toner feeding member 9*b* and the first antenna rod 9*h* in a whole longitudinal area of the toner-feeding member 9*b* and is fixedly held by the toner container 11A via an elastic-member holding member 21. Further, the elastic member 20 has sufficient elasticity to drop the toner between the toner-feeding member 9*b* and the first antenna rod 9*h* by shock or vibration when the elastic member comes into contact with the rotating toner-feeding member 9*b* and not to prevent the toner-feeding member 9*b* from rotating.

Further, as shown in FIG. 13, a cut-away portion 16*g* is formed in a part of periphery of the contact member 16*d* slidingly contacting the contact member 18*a* to interrupt the electrical connection (between these contacts) for a very short time, and the timing of the interruption is synchronized with the timing of contact between the elastic member 20 and the toner feeding member 9*b*. A signal indicating the interruption is detected by the toner-remaining-amount detecting means 15, and a time period from the signal to an area in which the toner exists is monitored.

That is to say, as shown in FIG. 12, in a state in which the toner upper surface 19 is located within the rotating area of the toner-feeding member 9*b* as a result that the toner is consumed, when the toner feeding member 9*b* and the first antenna rod 9*h* are rotated to move to the toner non-existing area from the toner existing area through the toner upper surface 19, the toner may be clogged between the toner-feeding member 9*b* and the first antenna rod 9*h*. In this state, the toner non-existing area cannot be detected. To avoid such inconvenience, the toner between the toner-feeding member 9*b* and the first antenna rod 9*h* is surely scraped off by the elastic member 20. And, a time period t22 from a time when the toner is scraped off to a time when the toner-feeding member 9*b* and the first antenna rod 9*h* reach the toner upper surface 19 again (in the state in which there is no toner between the toner-feeding member 9*b* and the first antenna rod 9*h*) is detected on the basis of the change in electrostatic capacity similar to the first embodiment of the present invention.

With the arrangement as mentioned above, on the basis of the change in electrostatic capacity between the toner-feeding member 9*b* and the first antenna rod 9*h* and the change in electrostatic capacity between the second antenna rod 9*i* and the developing roller 9*c* detected by the similar arrangement as the first embodiment, the remaining amount of toner in the toner container 11A can successively be detected with high accuracy. By informing the user of the detected toner-remaining amount successively through the informing means such as a monitor, the user can easily the how amount of toner remaining in the process cartridge B. Incidentally, in the illustrated embodiment, as shown in FIG. 2, a display portion 100 is provided. The display portion 100 can successively indicate the toner-remaining amount by moving a pointer 100*a*. In the above-mentioned embodiments, as an example in which the agitating portion is provided with the antenna portion, the toner feeding member 9*b* and the first antenna rod 9*h* was explained. However, the agitating portion may be constituted by a non-conductive plastic sheet and first and second electrodes may be provided on the plastic sheet.

In the process cartridge B according to the second embodiment of the present invention, since the cut-away portion 16*g* detects the optimum posture timing of the toner-feeding member 9*b*, so long as the electrical connection is interrupted at that timing, it is not limited to the cut-away portion. For example, in place of the cut-away portion. For example, in place of the cut-away portion, a non-conductive coating or a projection may be provided.

Figure 14:
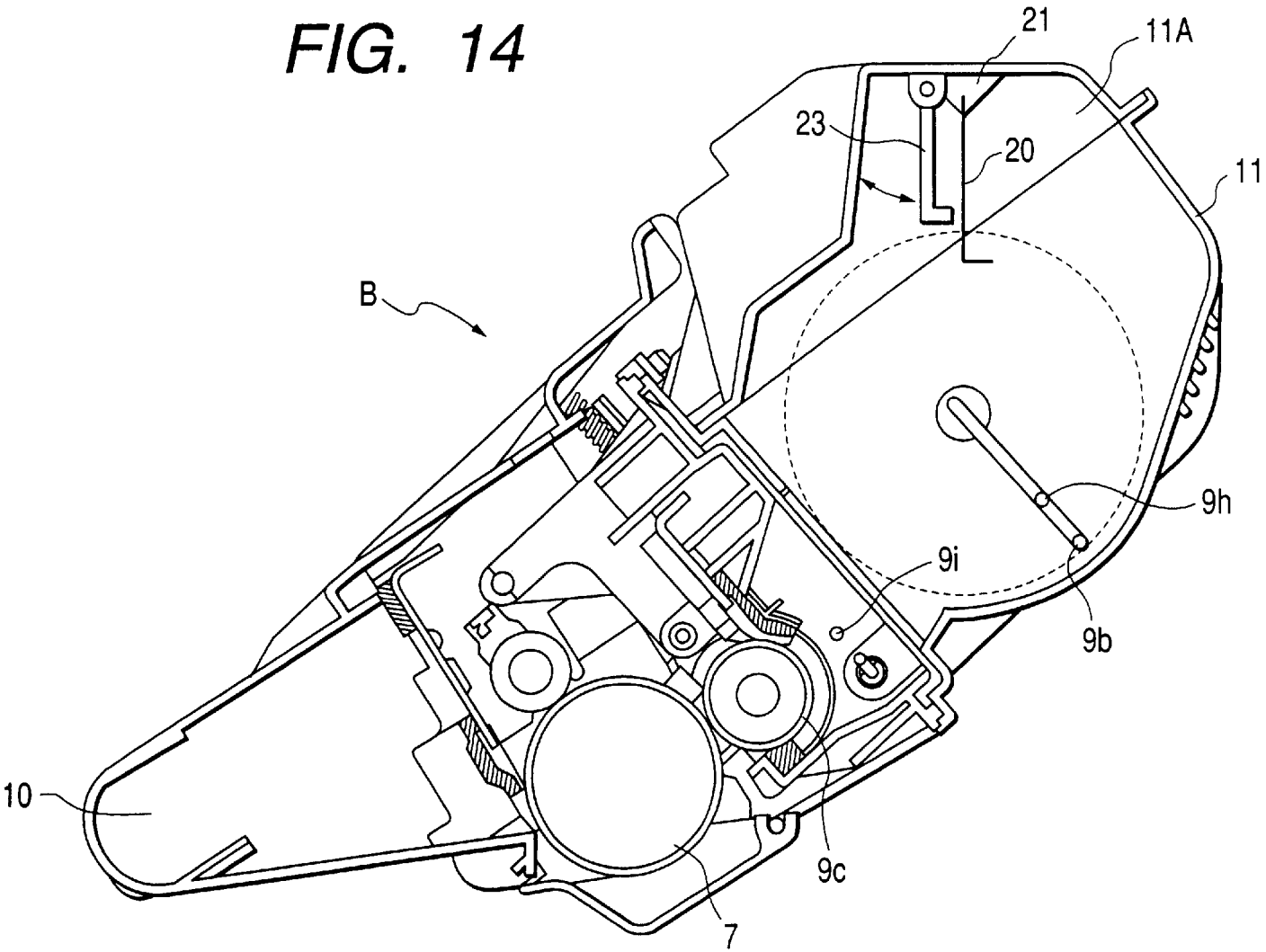
FIG. 14 is a vertical sectional view of a process cartridge according to a further embodiment of the present invention.

Alternatively (instead of the interruption due to the cut-away portion 16*g*), for example, as shown in FIG. 14, a sensor 23 for detecting falling of the elastic member 20 (for example, detecting a movement of a rod or a plate-shaped member rotated by the falling of the elastic member) may be provided in a direction along which the elastic member 20 is fallen, thereby detecting the optimum posture timing starting the toner detection of the toner-feeding member 9*b*.

Figure 15:
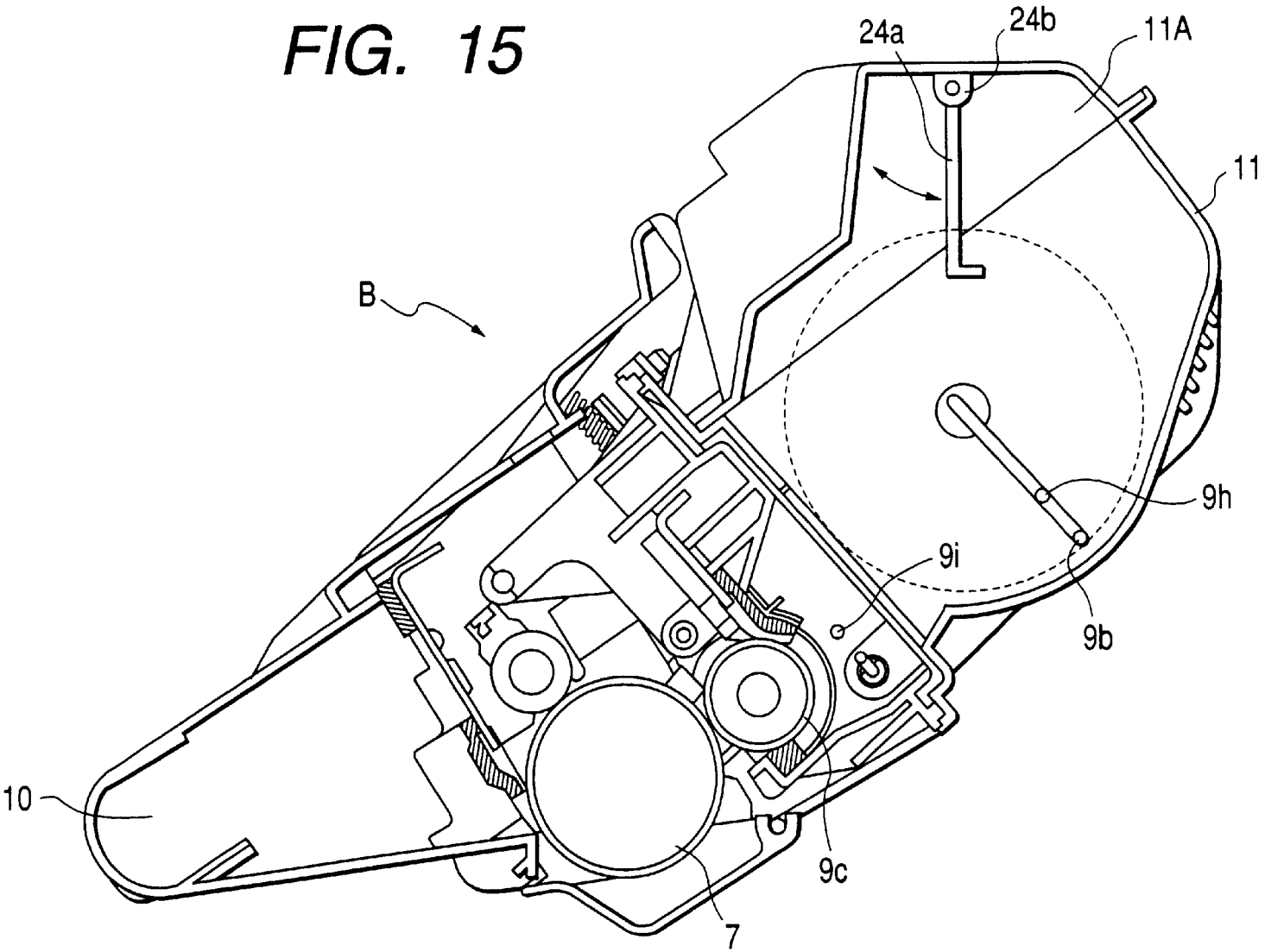
FIG. 15 is a vertical sectional view of a process cartridge according to a further embodiment of the present invention.

Further, as shown in FIG. 15, in place of the elastic member 20, an arrangement in which a plate-shaped rigid member 24*a* having an L-shaped cross-section is rotatably supported by a hinge portion 24*b* at its proximal end so that the plate-shaped member 24*a* suspended from the hinge portion 24*b* by its own weight may be used. In this case, by using the arrangement including the cut-away portion 16*g* described in connection with the second embodiment, the optimum posture timing of the toner-feeding member 9*b* starting the toner detection may be detected.

Figure 16:
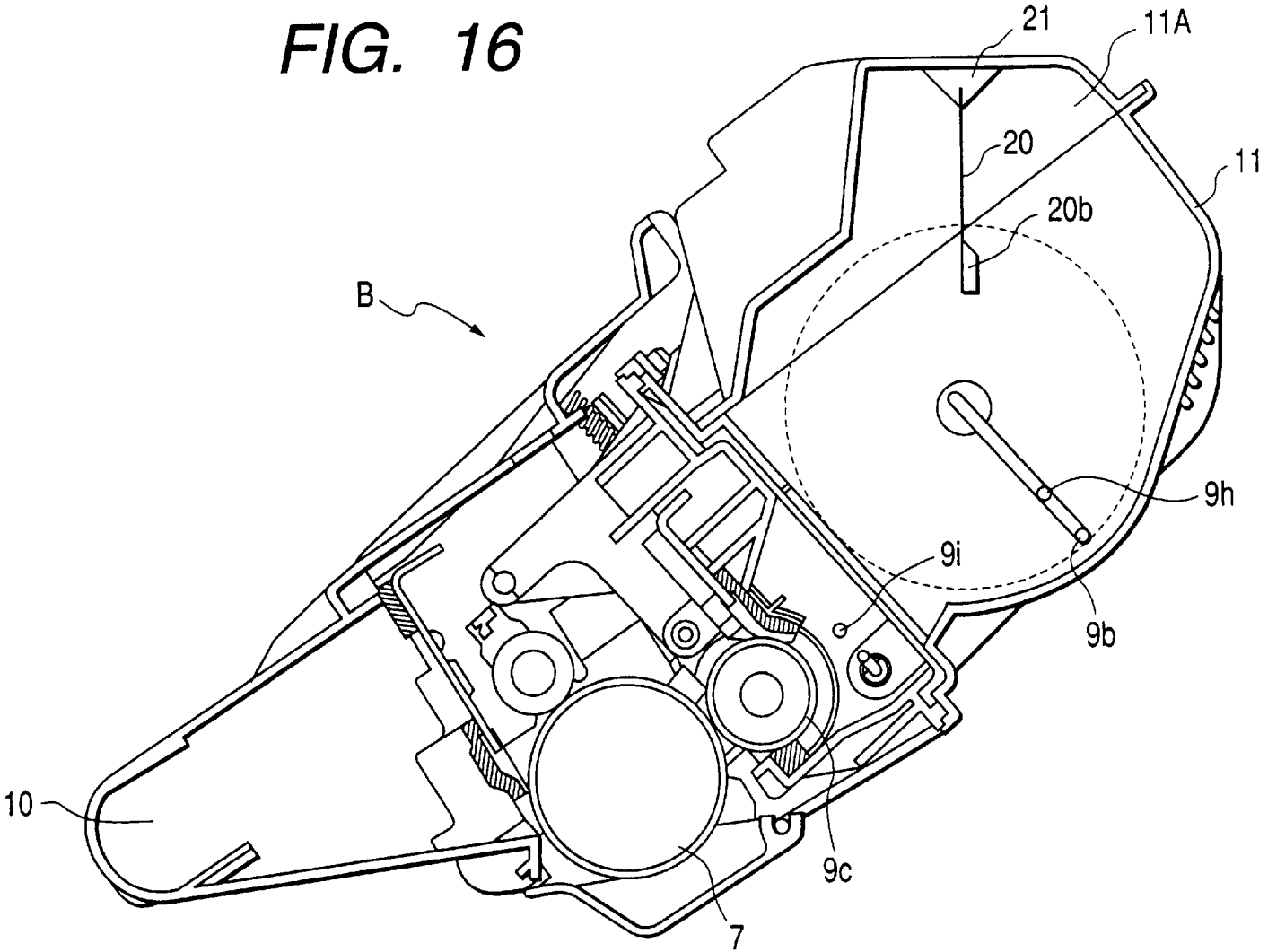
FIG. 16 is a vertical sectional view of a process cartridge according to a further embodiment of the present invention.
Figure 17:
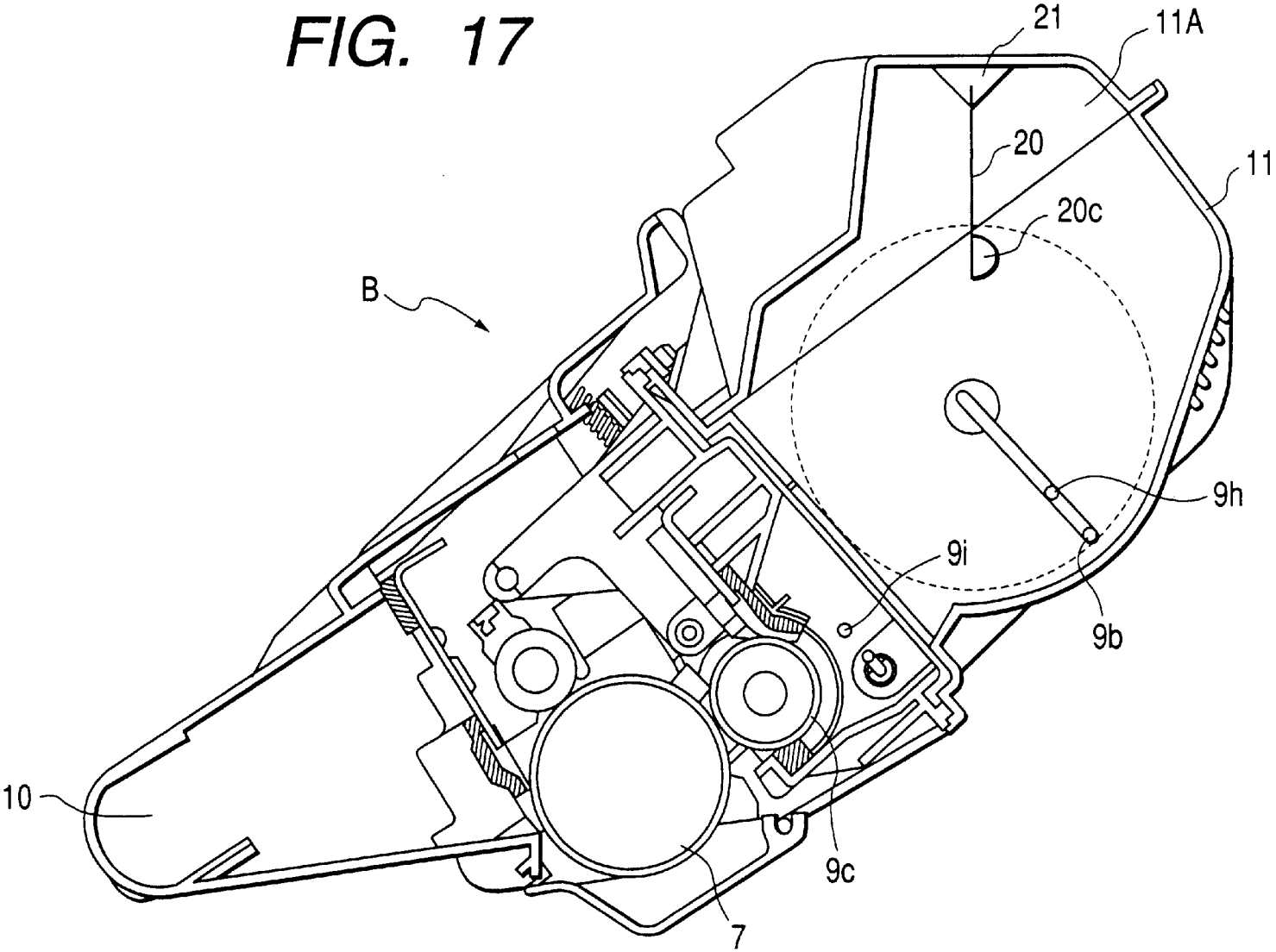
FIG. 17 is a vertical sectional view of a process cartridge according to a further embodiment of the present invention.

Further, the cross-section of each of the elastic member 20 and the plate-shaped member 24*a* is not limited to the L-shape, but, for example, as shown in FIGS. 16 and 17, a free end or distal end of the elastic member 20 may be formed as a plurality of leveled or curved surface portions arranged in a line, such as plate-shaped end portions 20*b* or semi-circular end portions 20*c* which can be opposed to a space between the toner-feeding member 9*b* and the first antenna member 9*h* to achieve the same effect.

In the above-mentioned embodiments, while the process cartridge detachably mountable to the main body of the electrophotographic image forming apparatus, and the electrophotographic image forming apparatus to which the process cartridge can detachably be mounted and which is adapted to form the image on the recording medium were explained, the present invention can be applied to a developing device detachably mountable to a main body of an electrophotographic image forming apparatus, and an electrophotographic image forming apparatus to which a developing device can detachably be mounted and which is adapted to form an image on a recording medium. Further, the present invention can also be applied to an electrophotographic image forming apparatus in which a process cartridge is not used. In addition, according to the above-mentioned embodiments, while an example in which the movable antenna member is provided on the agitating member was explained, the present invention is not limited to the example.

As mentioned above, according to the present invention, in the developing device, the antenna member is moved through the toner within the toner-containing portion and the toner remaining-amount is detected on the basis of the change in electrostatic capacity between the electrodes of the antenna member so that the toner-remaining amount in the moving area of the antenna member can successively be detected with high accuracy, thereby providing a developing device in which a service life thereof can easily be guessed by the user.

Further, according to the present invention, the first antenna member is movable and serves to detect the remaining amount of toner in the toner-containing portion. And, since the second antenna member is fixed and, since the second antenna member detects the toner remaining amount on the basis of the change in electrostatic capacity between the second antenna member and the developing member, the remaining amount of almost all of toner in the toner-containing portion can successively be detected with high accuracy, thereby providing a developing device in which a service life thereof can easily be guessed by the user.

Since the movable antenna member also acts as an agitating member, it is not required that an additional agitating member is provided.

The above-mentioned effects or advantages can be achieved by a process cartridge including developing means having the same construction as that of the above-mentioned developing device.

Further, according to the electrophotographic image forming apparatus to which the developing device or the process cartridge can detachably be mounted, the service life of the developing device or the process cartridge can be estimated with leaving a margin.

While the invention has been described with reference to the structures disclosed herein, it is not confined to the details set forth and this application is intended to cover such modifications or changes as may come within the purposes of the improvements or the scope of the following claims.

What is claimed is:

1. A developing device detachably mountable to a main body of an electrophotographic image forming apparatus and adapted to develop a latent image formed on an electrophotographic photosensitive member, comprising:

a developing member for developing the latent image formed on said electrophotographic photosensitive member;

a toner containing portion for containing toner to be used by said developing member to develop the latent image;

an antenna member provided with electrodes and for detecting a remaining amount of the toner remaining in the developing device, said antenna member being movable within said developing device and said antenna member detecting the remaining amount of toner based on a change in electrostatic capacity between said electrodes; and an electrical contact for electrically transmitting information corresponding to the electrostatic capacity of said antenna member to said main body of said electrophotographic image forming apparatus.

2. A developing device according to claim 1, wherein said antenna member is provided on a toner agitating member which is disposed in said toner containing portion and which is rotatable around a shaft.

3. A developing device according to claim 1 or 2, wherein the toner remaining amount is detected successively.

4. A process cartridge detachably mountable to a main body of an electrophotographic image forming apparatus, comprising:

(a) an electrophotographic photosensitive member; and (b) a developing device for developing a latent image formed on said electrophotographic photosensitive member, said developing device including:

a developing member for developing the latent image formed on said electrophotographic photosensitive member, a toner containing potion for containing toner to be used by said developing member to develop the latent image, an antenna member provided with electrodes and for detecting a remaining amount of the toner remaining in said developing device, said antenna member being movable within said developing device and said antenna member detecting the remaining amount of toner based on a change in electrostatic capacity between said electrodes, and an electrical contact for electrically transmitting information corresponding to the electrostatic capacity of said antenna member to said main body of said electrophotographic image forming apparatus.

5. A process cartridge according to claim 4, wherein said antenna member is provided on a toner agitating member which is disposed in said toner containing portion and which is rotatable around a shaft.

6. A process cartridge according to claim 4 or 5, wherein the toner remaining amount is detected successively.

7. An electrophotographic image forming apparatus to which a process cartridge can detachably be mounted and which is adapted to form an image on a recording medium, comprising:

(a) a mounting member for detachably mounting a process cartridge, the process cartridge including an electrophotographic photosensitive member, and a developing device for developing a latent image formed on said electrophotographic photosensitive member, said developing device having a developing member for developing the latent image formed on said electrophotographic photosensitive member, a toner containing portion for containing toner to be used by said developing member to develop the latent image, an antenna member provided with electrodes and for detecting a remaining amount of the toner remaining in said developing device, said antenna member being movable within said developing device and said antenna member detecting the remaining amount of toner based on a change in electrostatic capacity between said electrodes, and a cartridge electrical contact for electrically transmitting information corresponding to the electrostatic capacity of said antenna member to a main body of said electrophotographic image forming apparatus;

(b) a main body electrical contact to be electrically connected to said cartridge electrical contact of said process cartridge when said process cartridge is mounted to said mounting member; and (c) an informing member for informing information regarding the toner remaining amount based on information which is received by said main body electrical contact from said cartridge electrical contact.

8. An electrophotographic image forming apparatus according to claim 7, wherein said antenna member is provided on a toner agitating member which is disposed in said toner containing portion and which is rotatable around a shaft.

9. An electrophotographic image forming apparatus according to claim 7 or 8, wherein the toner remaining amount is detected successively.

10. An agitating member used with a toner containing portion containing toner to be used to develop a latent image by a developing member for developing the latent image formed on an electrophotographic photosensitive member provided in a main body of an electrophotographic image forming apparatus, comprising:

an agitating portion which is rotatable around a shaft when said agitating portion is mounted to said toner containing portion;

an antenna member provided with electrodes, said antenna member provided in said agitating portion and adapted to detect a remaining amount of toner remaining in said toner containing portion, said antenna member detecting the remaining amount of toner based on a change in electrostatic capacity between said electrodes; and an electrical contact for electrically transmitting information corresponding to the electrostatic capacity of said antenna member to said main body of said electrophotographic image forming apparatus.

11. An agitating member according to claim 10, wherein the toner remaining amount is detected successively.

12. A developing device detachably mountable to a main body of an electrophotographic image forming apparatus and adapted to develop a latent image formed on an electrophotographic photosensitive member, comprising:

a developing member for developing the latent image formed on said electrophotographic photosensitive member;

a toner containing portion for containing toner to be used by said developing member to develop the latent image;

a first antenna member provided with electrodes and for detecting a remaining amount of the toner remaining in the developing device, said first antenna member being movable within said developing device and said first antenna member detecting the remaining amount of toner based on a change in electrostatic capacity between said electrodes;

a second antenna member which is fixed and which detects the toner remaining amount near said developing member based on a change in electrostatic capacity between said second antenna member and said developing member;

a first electrical contact for electrically connecting between said first antenna member and said main body of said electrophotographic image forming apparatus;

and a second electrical contact for electrically connecting between said second antenna member and said main body of said electrophotographic image forming apparatus.

13. A developing device according to claim 12, wherein said first antenna member is provided on a toner agitating member which is disposed in said toner containing portion and which is rotatable around a shaft.

14. A developing device according to claim 12 or 13, wherein the toner remaining amount is detected successively.

15. A developing device according to claim 12, wherein said second antenna member is disposed along a longitudinal direction of a developing roller as said developing member with a distance between said second antenna member and said developing roller.

16. A developing device according to claim 12, wherein said second antenna member detects the toner remaining amount based on a change in electrostatic capacity between said second antenna member and a developing roller as said developing member.

17. A process cartridge detachably mountable to a main body of an electrophotographic image forming apparatus, comprising:

(a) an electrophotographic photosensitive member; and (b) a developing device for developing a latent image formed on said electrophotographic photosensitive member, said developing device including:

a developing member for developing the latent image forced on said electrophotographic photosensitive member, a toner containing portion for containing toner to be used by said developing member to develop the latent image, a first antenna member provided with electrodes and for detecting a remaining amount of the toner remaining in said developing device, said first antenna member being movable within said developing device and said first antenna member detecting the remaining amount of toner based on a change in electrostatic capacity between said electrodes, a second antenna member which is fixed and which detects the toner remaining amount near said developing member based on a change in electrostatic capacity between said second antenna member and said developing member, a first electrical contact for electrically connecting between said first antenna member and said main body of said electrophotographic image forming apparatus, and a a second electrical contact for electrically connecting between said second antenna member and said main body of said electrophotographic image forming apparatus.

18. A process cartridge according to claim 17, wherein said first antenna member is provided on a toner agitating member which is disposed in said toner containing portion and which is rotatable around a shaft.

19. A process cartridge according to claim 17 or 18, wherein the toner remaining amount is detected successively.

20. A process cartridge according to claim 17, wherein said second antenna member is disposed along a longitudinal direction of a developing roller as said developing member with a distance between said second antenna member and said developing roller.

21. A process cartridge according to claim 17, wherein said second antenna member detects the toner remaining amount based on a change in electrostatic capacity between said second antenna member and a developing roller as said developing member.

22. An electrophotographic image forming apparatus to which a process cartridge is detachably mountable and which is adapted to form an image on a recording medium, comprising:

(a) a mounting member for detachably mounting a process cartridge, the process cartridge including an electrophotographic photosensitive member, and a developing device for developing a latent image formed on said electrophotographic photosensitive member, said developing device having a developing member for developing the latent image formed on said electrophotographic photosensitive member, a toner containing portion for containing toner to be used by said developing member to develop the latent image, a first antenna member provided with electrodes and for detecting a remaining amount of the toner remaining in the developing device, said first antenna member being movable within said developing device and said first antenna member detecting the remaining amount of the toner based on a change in electrostatic capacity between said electrodes, a second antenna member which is fixed and which detects the toner remaining amount near said developing member based on a change in electrostatic capacity between said second antenna member and said developing member, a first electrical contact for electrically connecting between said first antenna member and said main body of said electrophotographic image forming apparatus, and a second electrical contact for electrically connecting between said second antenna member and said main body of said electrophotographic image forming apparatus;

(b) a first main body electrical contact to be electrically connected to said first electrical contact of said process cartridge when said process cartridge is mounted to said mounting member;

(c) a second main body electrical contact to be electrically connected to said second electrical contact of said process cartridge when said process cartridge is mounted to said mounting member; and (d) an informing member for informing information regarding the toner remaining amount based on information which is received by said first and second main body electrical contacts.

23. An electrophotographic image forming apparatus for forming an image on a recording medium, comprising:

(a) an electrophotographic photosensitive member;

(b) a developing device for developing a latent image formed on said electrophotographic photosensitive member, said developing device including a developing member for developing the latent image formed on said electrophotographic photosensitive member, a toner containing portion for containing toner to be used by said developing member to develop the latent image, an antenna member provided with electrodes and for detecting a remaining amount of the toner remaining in said developing device, said antenna member being movable within said developing device and said antenna member detecting the remaining amount of toner based on a change in electrostatic capacity between said electrodes, and a developing device electrical contact for electrically transmitting information corresponding to the electrostatic capacity of said antenna member to a main body of said electrophotographic image forming apparatus;

(c) a main body electrical contact being electrically connected to said developing device electrical contact of said developing device; and (d) an informing member for informing information regarding the toner remaining amount based on information which is received by said main body electrical contact from said developing device electrical contact.

24. An electrophotographic image forming apparatus for forming an image on a recording medium, comprising:

(a) an electrophotographic photosensitive member;

(b) a developing device for developing a latent image formed on said electrophotographic photosensitive member, said developing device including a developing member for developing the latent image formed on said electrophotographic photosensitive member, a toner containing portion for containing toner to be used by developing member to develop the latent image, a first antenna member provided with electrodes and for detecting a remaining amount of the toner remaining in said developing device, said first antenna member being movable within said developing device and said first antenna member detecting the remaining amount of toner based on a change in electrostatic capacity between said electrodes, a second antenna member which is fixed and which detects the toner remaining amount near said developing member based on a change in electrostatic capacity between said second antenna member and said developing member, a first electrical contact for electrically connecting between said first antenna member said main body of said electrophotographic image forming apparatus, and a second electrical contact for electrically connecting between said second antenna member and said main body of said electrophotographic image forming apparatus;

(c) a first main body electrical contact being electrically connected to said first electrical contact of said developing device;

(d) a second main body electrical contact being electrically connected to said second electrical contact of said developing device; and (e) an informing member for informing information regarding the toner remaining amount based in information which is received by said first and second main body electrical contacts.

* * * * *

UNITED STATES PATENT AND TRADEMARK OFFICE

CERTIFICATE OF CORRECTION

PATENT NO. : 6,208,816 B1
DATED : March 27, 2001
INVENTOR(S) : Toru Koizumi, et al.

It is certified that error appears in the above-identified patent and that said Letters Patent is hereby corrected as shown below:

Column 3,
Line 33, "a" (second occurrence) should read -- the --.

Column 5,
Line 23, "illuminate" should read -- illuminates --.

Column 6,
Line 30, "toner feeding member" should read -- toner-feeding-member --.

Column 7,
Line 62, "toner remaining" should read -- toner-remaining --.

Column 8,
Line 11, "alternate" should read -- alternating --.
Line 45, "the" should read -- by the --.
Line 63, "absent" should read -- absence --.

Column 9,
Line 6, "toner-remaining amount" should read -- toner-remaining amount --.
Line 19, "toner-remaining-" should read -- toner-remaining --.
Line 22, "toner-remaining-amount" should read -- toner-remaining amount --.
Line 42, "lid" should read -- 11d --.
Line 59, "is contacted with" should read -- contacts --.

Column 10,
Line 36, "toner-remaining-amount" should read -- toner-remaining amount --.
Line 42, "remaining-amount" should read -- remaining amount --.
Line 67, "toner remaining" should read -- toner-remaining --.

UNITED STATES PATENT AND TRADEMARK OFFICE

CERTIFICATE OF CORRECTION

PATENT NO. : 6,208,816 B1
DATED : March 27, 2001
INVENTOR(S) : Toru Koizumi, et al.

It is certified that error appears in the above-identified patent and that said Letters Patent is hereby corrected as shown below:

Column 12,
Line 46, "easily" should read -- easily know --.
Line 47, "how" should be deleted.

Column 13,
Line 47, "toner remaining-amount" should read -- toner-remaining amount --.

Column 17,
Line 11, "a" should be deleted.

Column 18,
Line 59, "member" should read -- member and --.

Column 19,
Line 5, "in" should read -- on --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*